US006999001B2

(12) United States Patent
Kojima

(10) Patent No.: US 6,999,001 B2
(45) Date of Patent: Feb. 14, 2006

(54) CARD PROCESSING SYSTEM AND CARD PROCESSING METHOD ON TOLL ROAD

(75) Inventor: Hideaki Kojima, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 202 days.

(21) Appl. No.: 10/607,558

(22) Filed: Jun. 27, 2003

(65) Prior Publication Data

US 2004/0004120 A1 Jan. 8, 2004

(30) Foreign Application Priority Data

Jul. 2, 2002 (JP) ..... 2002-193614
Jul. 2, 2002 (JP) ..... 2002-193615

(51) Int. Cl.
*G08G 1/065* (2006.01)

(52) U.S. Cl. ..... 340/928; 340/937; 235/384; 701/117

(58) Field of Classification Search ..... 340/928, 340/933, 937, 436; 235/384, 375, 383; 701/117
See application file for complete search history.

(56) References Cited

U.S. PATENT DOCUMENTS 6,042,008 A * 3/2000 Ando et al. ..... 235/384

* cited by examiner

*Primary Examiner*—Davetta W. Goins
(74) *Attorney, Agent, or Firm*—Pillsbury Winthrop Shaw Pittman LLP

(57) ABSTRACT

A wireless type pre-paid IC card system enhances the convenience of users and assures the safe payment of tolls by vehicles including bikes when introduced for toll roads. This toll collecting system is composed of: a card processor that is arranged in a booth for the toll collection process and has an antenna unit for executing the card process through the wireless communication with IC cards, antenna units arranged at the left and right roadsides of the booth for executing the card process through the wireless communication with IC cards, a vehicle class discriminator for discriminating classes of vehicles entering into a traffic lane, and a traffic lane controller that selects an antenna unit to perform the card process according to a discriminated vehicle class and controls the card process.

2 Claims, 16 Drawing Sheets

CARD PROCESSING SYSTEM AND CARD PROCESSING METHOD ON TOLL ROAD

BACKGROUND OF THE INVENTION

1. Field of the Invention

The present invention relates to a card processing system and a card processing method used in a toll road.

2. Description of the Related Art

Magnetic type pre-paid cards (hereinafter, referred to as magnetic cards) that are currently in use widely in the market are highly usable for users because the cards are anonymous in indefinite terms and usable by many unspecified persons.

On the other hand, magnetic cards always have a risk of illegal rewriting of recorded data such as monetary information, etc. From the viewpoint of weakness of security, a balance of pre-paid amount of magnetic cards is only subtracted and generally discarded when a balance of amount becomes zero (0).

So, the security of magnetic cards that are highly usable is promoted by making them in IC cards in recent years.

In the transportation facilities, for example, railway facilities, a card processing system using wireless type pre-paid IC cards that are used to enter/exit to/from an automatic ticket examiner installed at an entrance gate by touching or holding up a pre-paid IC card to or over the machine is already put in practical use.

From now on, it is expected that wireless type pre-paid IC cards will be introduced into other transportation facilities, for example, toll roads, etc. However, a toll collection system called as the Electronic Toll Collection System (ETC System) is already introduced for toll roads. For this ETC system, however, users are forced to make a contract for use of a credit card type IC card, purchase of an on board vehicle unit and set up it on a vehicle for the wireless communication with a system. Because of this, the current state is such that the switching of the ETC system card to the current magnetic type pre-paid card is not further progressed Further, the ETC system is of a credit card type, there is no such a trouble generated as short of balance amount at the time of payment of toll and it is not necessary for a clerk to cope with. However, in the case of wireless type pre-paid IC cards, as a clerk is required to cope with when a balance of amount recorded thereon is short, it is required for a clerk to collect roll after properly discriminating a vehicle having a short balance amount.

SUMMARY OF THE INVENTION

An object of the present invention is to provide a card processing system and a card processing method capable of introducing an IC type pre-paid card system with enhanced security while maintaining convenience of anonymous and disposable magnetic type pre-paid cards and assuring safety of vehicles passing a toll road as a toll collection system and a card processing method in a toll road.

According to the present invention, a card processing system is provided. This system is composed of: a booth installed at the roadside of a traffic lane to perform the process relative to use of a toll road by a vehicle passing it; a first antenna unit arranged in a booth to perform the data process of IC cards through the wireless communication with IC cards; a second antenna unit arranged at the roadside of the lane outside the booth to perform the data process of IC cards through the wireless communication with the IC cards; and a data processing unit to perform the process relative to the use of the toll road based on card data obtained in the data process with at least the second antenna unit or the first antenna unit.

Further, according to the present invention, a card processing system comprising an entrance system for the entrance process at the entrance of the toll road for a vehicle passing the toll road and an exit system for the exit process for a vehicle using the toll road is provided. This entrance system is arranged at the roadside of the entrance and is composed of: an antenna unit having an antenna to which an IC card is brought close or contacts to make the wireless communication with the IC card and an entrance processing means that writes an entrance data into the IC card when the antenna of the antenna unit reads card data from the IC card by the wireless communication with the IC card and the card data is normal. The exit system is arranged in the booth at the roadside of the exit and is composed of: the second antenna unit having an antenna to which the IC card is closely brought or contacted to make the wireless communication with the IC card; and an exit processing means to write the result of process performed relative to the use of the toll road based on the entrance data contained in the data read from the IC card obtained by the wireless communication with the IC card by the antenna of either the first antenna unit or the second antenna unit.

Further, according to the present invention, a card processing method is provided. This method is composed of the steps of: executing the data process of the IC card through the wireless communication between the first antenna unit arranged in booth installed at the roadside of the lane for the process of a toll road for a vehicle passing the toll road with the IC card; executing the IC card data process through the wireless communication of the second antenna unit arranged at the roadside of the lane outside booth with the IC card; and executing the process relative to the use of the toll road based on the card data obtained from the data process by at least either one of the second or the first antenna unit.

DETAILED DESCRIPTION OF THE INVENTION

Preferred embodiments of the present invention will be described below in detail referring to the attached drawings.

Figure 1:
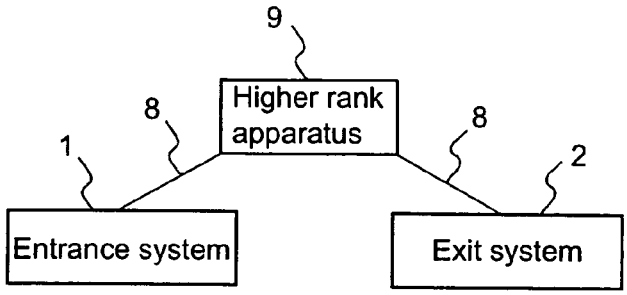
FIG. 1 is a block diagram showing the construction of the toll collection system to which the card processing system on a toll road of the present invention.

A card processing system and a card processing method of the present invention for a toll road are composed of an entrance system 1 installed at an entrance of a toll road and an exit system 2 installed at an exit of a toll road and a higher rank apparatus 9 such as a host computer, etc. connected to these entrance system 1 and the exit system 2 by way of a communication circuit 8 as shown in FIG. 1.

The higher rank apparatus 9 has functions to receive the result of the exit processing executed in the inside and outside of a traffic lane at the exit and an entrance data processed on a card at the entrance from the communication circuit 8, collate both data and when any difference is recognized, register that IC card as an illegal card in own data base, and inform this illegal card to the entrance and the exit booths. In addition, an inherent identification data of an illegal card may be provided to the entrance and the exit booths.

Figure 2:
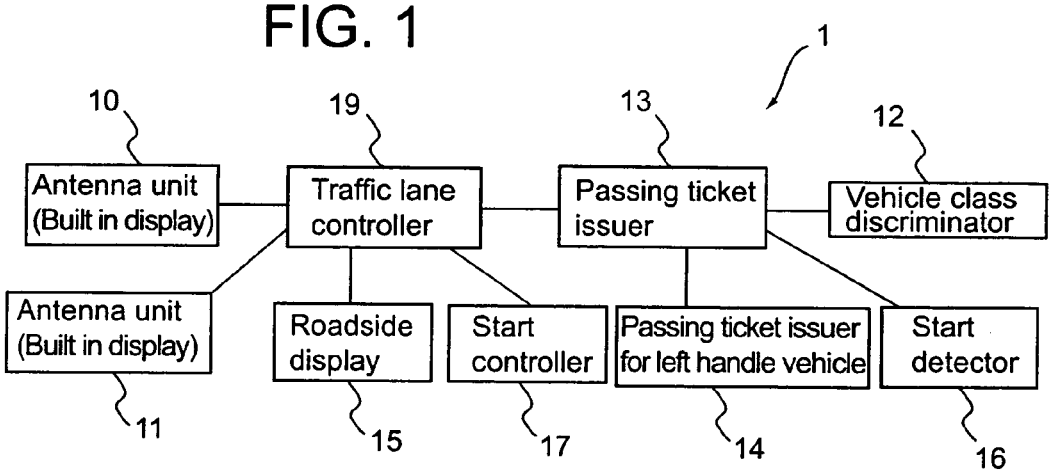
FIG. 2 is a block diagram showing the construction of the entrance system of the toll collection system shown in FIG. 1.
Figure 3:
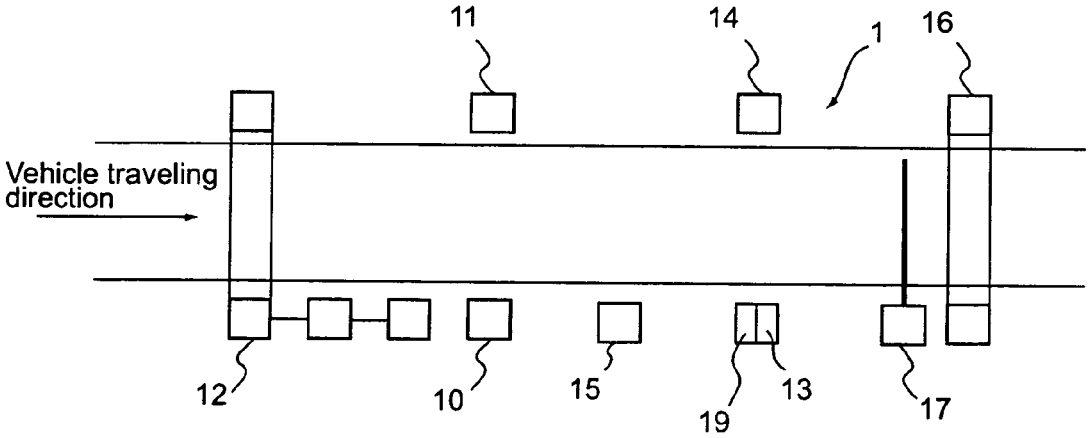
FIG. 3 is a schematic diagram showing the layout of equipment of the entrance system shown in FIG. 2.

As shown in FIG. 2 and FIG. 3, the entrance system 1 is composed of an antenna unit 10, an antenna unit 11, a vehicle class discriminator 12, a passing ticket issuer 13, a passing ticket issuer for left handle vehicles 14, a roadside display 15, a start detector 16, a start controller 17 and a traffic lane controller 19.

The antenna unit 10 is arranged at a roadside position to which a vehicle driver is able to reach it by extending the hand from the window after once stopping a vehicle entered into the traffic lane. When a non-contact IC type pre-paid card (hereinafter, referred to as IC card) that is a wireless pre-paid IC card is brought close to a prescribed range (to touch or hold up over) the antenna unit 10, vehicle class data and entrance data are recorded on the IC card through the wireless communication (non-contact). The prescribed range differs from the communication range of an ETC provided on a vehicle and, for example, within several ten cm.

An IC card stores individual card data such as Card ID No., variable data such as a pre-paid amount of money (a balance) data and using history data as card data in a built-in IC chip. The using history data includes vehicle class data discriminated and entrance data in the entrance processing. Further, on the card surface, an individual Card ID No. is printed so that this IC card can be visually specified.

The antenna unit 11 is arranged at the roadside position almost opposing to the antenna unit 10 with the traffic lane between and records a vehicle class data and an entrance data on an IC card held up by a left handle vehicle driver through the wireless communication (non-contact). The vehicle class discriminator 12 detects a vehicle entering into the traffic lane and acquires such data as the number of axles, height, length, number plate, etc. of the entering vehicle, and discriminates a vehicle class from the acquired vehicle data. The vehicle class referred to here is a kind of vehicle, for example, a large type, special large type, medium type, small type, light vehicle, etc. The passing ticket issuer 13 issues a passing ticket corresponding to an entering vehicle class when the entrance processing by an IC card is normally completed. The passing ticket issuer for left handle vehicles 14 is arranged at the roadside position almost opposing to the passing ticket issuer 13 with the traffic lane between and issues a passing ticket to a left handle vehicle driver. The roadside display 15 displays the processing state and informs a vehicle driver of the contents of leading guidance. The start detector 15 detects a vehicle to start and leave the traffic lane after receiving a passing ticket by a driver or the entrance process by an IC card. The start controller 17 is to approve or block the passing of a vehicle according to the result of the entrance process. The traffic lane controller 19 is connected to various units including the antenna units 10 and 11 through the communication circuits, and by acquiring data from respective units, executes various processes relative to the use of a toll road (the entrance process) and the control of the roadside units (the control to make the card processing function of the antenna units 10 and 11 valid/invalid, the control to open/close the start controller 17). In a flat rate system, the toll collection process may be executed to collect a fare at the entrance.

Figure 4:
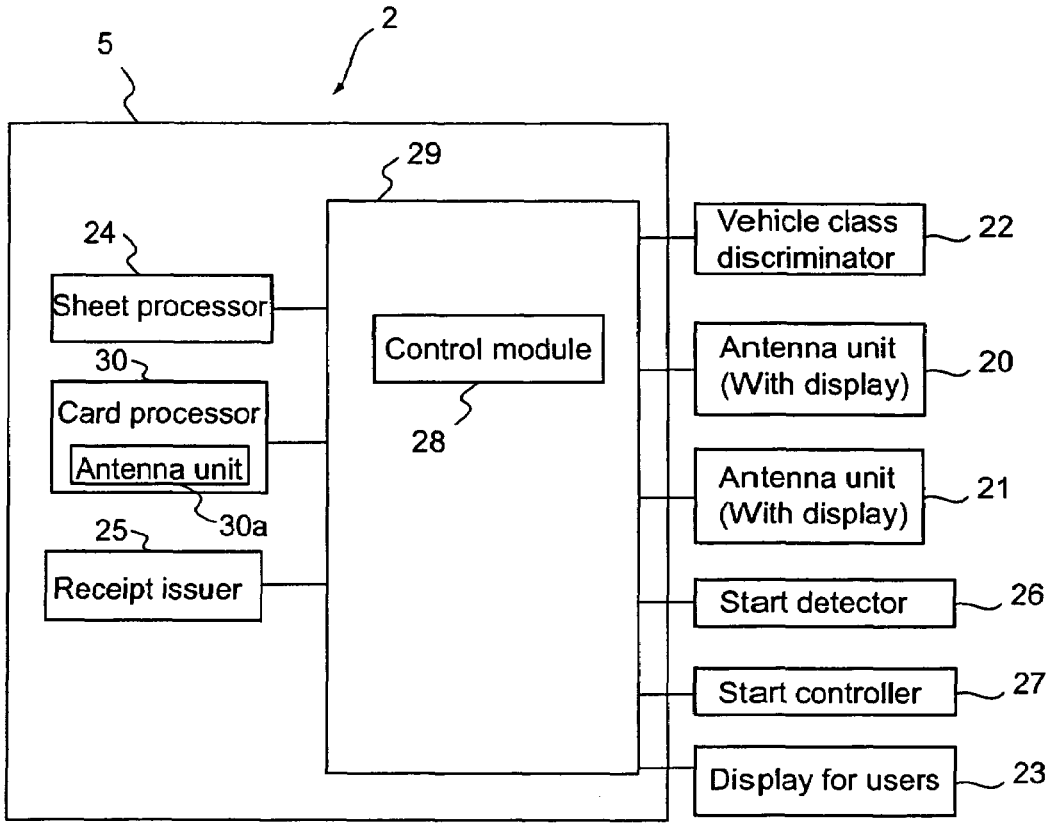
FIG. 4 is a block diagram showing the construction of the exit system of the toll collection system shown in FIG. 1.
Figure 5:
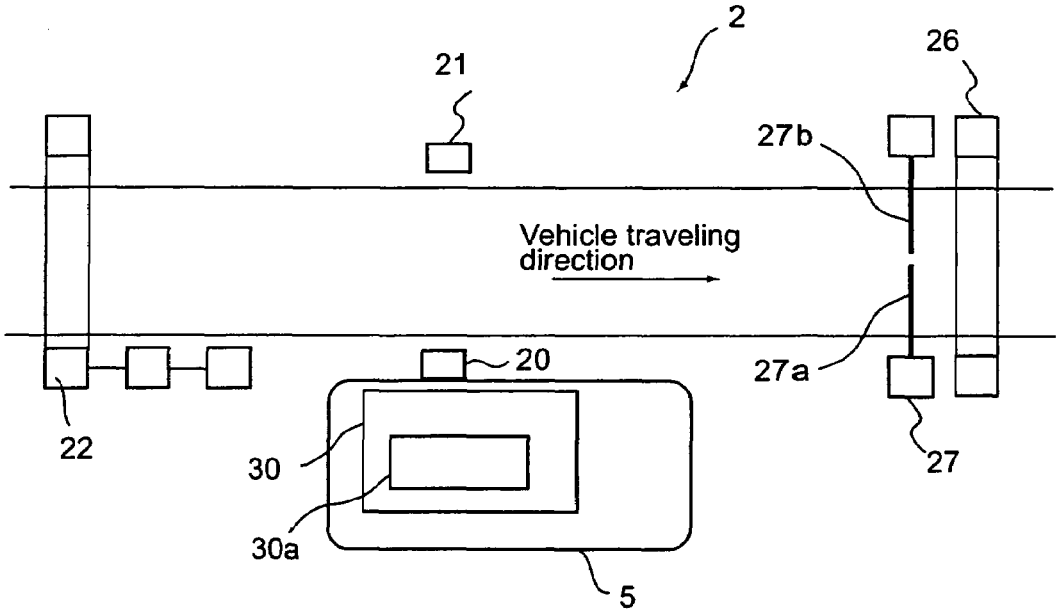
FIG. 5 is a schematic diagram showing the layout of equipment of the exit system shown in FIG. 4.

As shown in FIG. 4 and FIG. 5, the exit system 2 is composed of antenna units 20 and 21, a vehicle class discriminator 22, a display for users 23 to display the IC card processing state (shortage in amount of balance, subtracting amount, amount of balance after subtraction, etc.), to urge insertion of a card that is O an object of process, various guides when process errors are generated, a sheet processor 24 for process of passing tickets, etc., display for clerk in charge, input operation by clerk in charge, a receipt issuer 25 to issue certificates of use, etc., a start detector 26, a start controller 27, a card processor 30 incorporating such wireless communicating means as an antenna unit 30*a,* etc., and a traffic lane controller 29 with a built in control module 28 which acquires IC card information through the antenna unit 30*a* of this card processor 30 and executes the process relative to toll collection and control of roadside apparatus. The antenna unit 30*a* is provided to the card processor 30 for reading and writing data to/from an IC card when the IC card is held up over or touch the surface of the processor. The antenna unit 30*a* transmits radio waves in a communication range of, for example, several 10 cm and performs reading/writing and confirmation of data for IC chips of IC cards through resonance of transmitted radio waves and an IC card side antenna. The control module 28 of the traffic lane controller 29 is a memory and stores a control program for perform the process relative to IC cards and vehicles and the control of various units in the official the booth 5 or roadside units. Further, the control module 28 itself may be made a software. The traffic lane controller 29 executes the process of the control module 28 and performs various processes (the exit process, etc.) relative to use of a toll road and control of the above-mentioned units. The control module 28 pre-stores exit data (Tollhouse No. Lane Number, toll information of other tollhouses, etc.). The control module 28 (or the sheet processor 24, etc.) computes a toll (a using fare) from the entrance data and the exit data stored (recorded) on an IC card or a passing ticker for a vehicle leaving a toll road and collect it.

Figure 6:
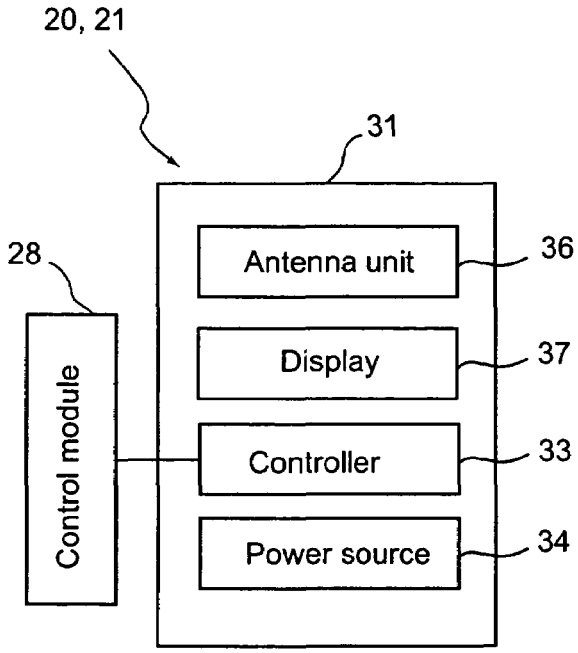
FIG. 6 is a block diagram showing the construction of the antenna unit of the card processing system in a toll road of the present invention.

The antenna units 20 and 21 are composed of a main body 31, a controller 33 connected to the control module 28 of the traffic lane controller 29, a power source 34, an antenna portion 36 and a display 37 as shown in FIG. 6. The antenna units 20 and 21 are connected to (interfaced with) the traffic lane controller 29 via the controller 33. The main body 31 houses various units shown below. The controller 33 totally controls the entire apparatus. The power source 34 supplies power to the units of the apparatus.

Figure 7A:
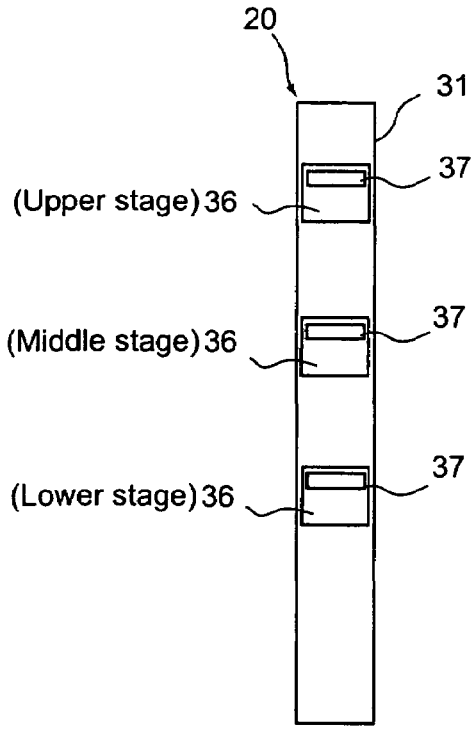
FIG. 7A is a front view showing the antenna unit arranged at the right side of a toll road.

The antenna unit 20 has a bar shape main body 31 erected at the right side of the traffic lane as shown in FIG. 7A. The main body 31 is equipped with an antenna portion 36 and a display 37 at the upper, middle and lower stages, respectively. The antenna portion 36 and the display 37 at the upper stage are for vehicles having relatively higher seats such as large vehicle, bus, etc. The antenna portion 36 and the display 37 at the middle stage are for such vehicle as high as residential vehicles, etc. The antenna portion 36 and the display 37 at the lower stage are for vehicle having relatively low seats such as passenger car, light car, motor bicycle, etc. Each display lights, flashes on/off or displays messages when the card processing function (the wireless communication function) of the antenna portion 36 selected by the traffic lane controller is valid. Messages referred to here are such that, for example, "Hold up your IC card over this position", "Wait a little until the process of a preceding vehicle is finished".

Figure 7B:
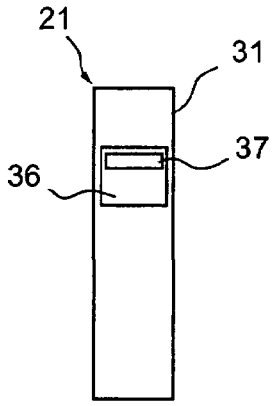
FIG. 7B is a front view showing the antenna unit arranged at the left side of a toll road.

The antenna unit 21 has a bar shape main body 31 erected at the left roadside of the traffic lane as shown in FIG. 7B. The main body 31 is equipped with the antenna unit 31 and the display 37 at the position of the same height as the lower stage of the antenna unit 20. The antenna portion 36 and the display 37 are arranged at the positions that a left handle vehicle driver is able to reach through the window. The display 37 lights, flashes on/off or displays a message when the card processing function (the wireless communication function) of the antenna portion 36 is valid.

Further, to make the card processing function (the wireless communication function) of respective antenna portions 36 valid or invalid, all antenna portions 36 are normally kept stopped and when a vehicle discriminated by the vehicle class discriminator 22, only antenna portion 36 at a position corresponding to that vehicle class is operated. Or all the antenna portions 36 may be operated and when a vehicle is discriminated by the vehicle class discriminator 22, the antenna portions 36 other than the antenna portion 36 at the position corresponding to that vehicle class may be stopped (turn off the wireless communication function). The antenna units 20 and 21 of the exit system and the antenna units 10 and 11 of the entrance system have the same number of stages and functions.

An IC card that is used for this toll collection system, that is, a wireless communication type non-contact pre-paid IC card that can be processed by the antenna units 30*a,* 10 and 11 of the card processor 30 is provided with an IC chip called a wireless tag and an antenna that is formed by the patterning (a copper foil printed wiring) of conductors on the inner substrate. Further, in this example, the IC card will be explained by taking a wireless communication type non-contact pre-paid IC card as an example but this is also applicable to a contact type IC card provided with a metal contact on the surface.

The operation of this toll collection system will be explained below referring to FIG. 8~FIG. 14.

Figure 8:
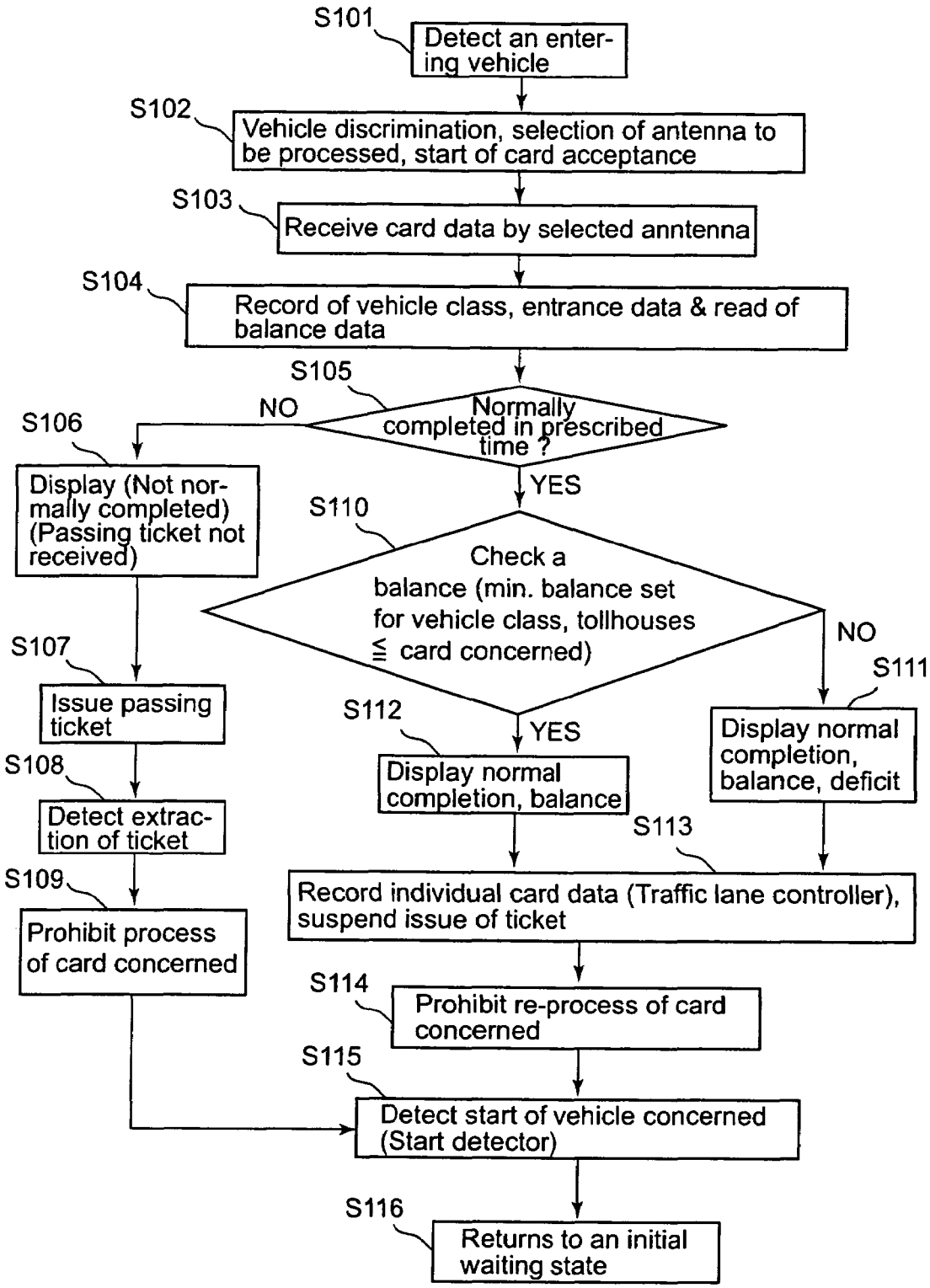
FIG. 8 is a flowchart showing the entrance processing operation of a toll collection system with the card processing system of the present invention applied.

First, the operation of the entrance process will be explained referring to a flowchart shown in FIG. 8.

When a vehicle enters into a traffic lane, that is, an entrance lane for executing the process relative to use of a toll road, for example, the entrance process including the writing process of entrance data on IC cards at a toll booth that is an entrance of a toll road, the vehicle is detected by the vehicle class discriminator 12 (S101). At the same time, a vehicle class is discriminated from such vehicle data as the number of axles, height, number plate, etc. of the entering vehicle and these data are notified to the traffic lane controller 19. When notified of these data, the traffic lane controller 19 selects the antenna portion 36 at an applicable height (either the upper, middle or lower stage) in the case of the antenna units 10 and 11 that process an IC card of the vehicle and making the card processing function of the antenna portion 36 valid, starts to accept an IC card (S102). To make the card processing function valid is to bring the waiting state wherein radio wave is not transmitted in order for power saving to the card process waiting state by transmitting radio wave.

In this case, for example, when an ordinary right handle vehicle enters into the entrance lane, the antenna portion 36 at the lower stage of the antenna unit 10 is selected, the display 37 at that position lights, flashes on/off or displays a message and radio wave is transmitted from the antenna portion 36.

A vehicle driver who sees the lighting, flashing on/off or display of a message on the display 37 brings a non-contact IC type pre-paid card (hereinafter, called as an IC card) out of the vehicle window close to (or holds over) the antenna portion 36 at the lower state of the antenna portion 36, the IC card data (amount of balance, etc.) is read through the wireless communication between the antenna portion 36 and the IC card and received by the antenna portion 36 (S103). When the IC card data received by the antenna portion 36 is proper data, vehicle class data (a number showing an ordinary vehicle) and entrance data (toll booth number, lane number, entrance passing time, etc.) are transmitted from the antenna unit 10 and recorded on the IC card (S104).

Then, when the card process is not normally finished within a pre-set time (NO of S105), the traffic lane controller 19 displays that it is necessary to receive a passing ticket because the card process was not normally completed (S106) and issues a passing ticket to that vehicle (S107). When a passing ticket is pulled out of the passing ticket issuer 13 or the passing ticket issuer for left handle vehicles 14 and the passing ticket issuer 13 or the passing ticker issuer for left handle vehicles 14 detects it (S108) and notifies to the traffic controller 19, the traffic controller prohibits the process for IC card (S109) and the acceptance of the IC card process.

On the other hand, when the card processing is normally completed within a pre-set time (YES of S105), the traffic lane controller 19 performs the balance amount checking process (S110). This balance amount checking process is made by comparing the actual amount of balance obtained from an IC card with the minimum amount of balance that is pre-set for every vehicle class and toll booth.

Minimum amount set for vehicle class and toll booth≦Actual amount of balance of the card When a balance on IC card is less than a pre-set amount for every vehicle class and toll booth (NO of S110) as a result of this balance amount checking, the normal completion of the card process with a balance and deficit of a balance are displayed on the roadside display 15 (S111).

Further, when it is revealed as a result of the balance amount verification process that the amount of balance on an IC card is above the amount pre-set for every vehicle class and toll booth and the balance amount verification process is completed normally (YES of S110), the traffic lane controller 19 displays the normal completion of the card process and a amount of balance on the roadside display 15 (S112).

Then, the traffic controller 19 records individual data of the card and stops to issue a passing ticket by issuing a passing ticket issue stop command to the passing ticket issuer 13 (or the passing ticket issuer for left handle vehicles) 14) (S113).

Further, the traffic lane controller 19 issues a command to all antenna units 10 and 11 installed at the entrance lane to prohibit the re-process of a card until that vehicle passes through the start detector 16 (S114) to prevent the duplicated process of the card (the double process).

Thereafter, when the start of the vehicle is detected by the start detector 16 (S115) and the entrance of a succeeding vehicle is detected by the vehicle class discriminator 12, the traffic lane controller 19 returns to the initial waiting state (S116) and starts accepting the IC card process again.

Figure 9:
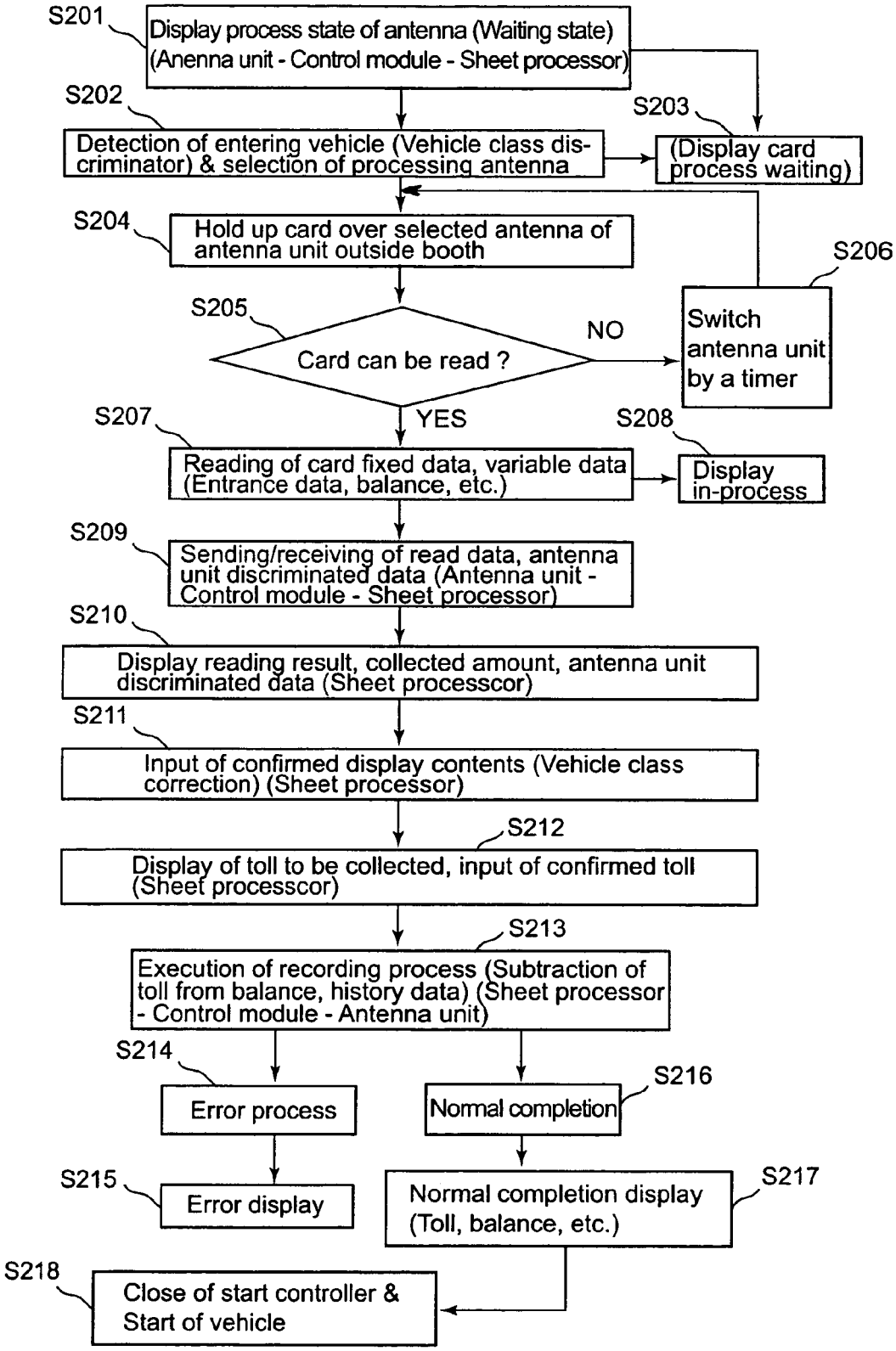
FIG. 9 is a flowchart showing the exit processing when the entrance processing is not normally completed.

The toll collection processing operation at the exit is explained referring to a flowchart shown in FIG. 9. FIG. 9 is a flowchart showing the exit process when the entrance process is normally completed.

At the traffic lane that performs the process relative to the use of a toll road by vehicles, for example, the toll collection process of a toll road by reading card data including entrance data from IC cards at a toll booth which is the exit of a toll road, that is, the exit lane, the processing state of the antenna units 20 and 21 (the waiting state, the card process waiting state, the state of in-process and the result of process, etc.) is constantly notified to the traffic lane controller 29 and then, to the sheet processor 24 from the control module 28 of the traffic lane controller 29 (S201).

When a vehicle enters into the exit lane from a toll road in this state, the entering vehicle is detected by the vehicle class discriminator 22 and the traffic lane controller 29 starts the exit process.

When a vehicle is detected by the vehicle class discriminator 22, the traffic lane controller 29 first selects an antenna unit (either the antenna unit 20 or 21) in a height suited to the card processing based on the vehicle data detected by the vehicle class discriminator 22 and the antenna portion 36 at the upper, middle or lower stage of the antenna unit 20 and the display 37 (S202) and then, placing the antenna portion 36 in the card process waiting state from the waiting state and turns on or flashes on/off the display 37 or displays a message to show that the system operation is in the process waiting state (S203).

When a vehicle driver stops the vehicle at the position of the antenna unit 20 in the traffic lane (a the booth 5) and extends own hand from the vehicle window and holds up an IC card over the antenna unit 37 of the antenna unit 20 (S204), whether the contents of this IC card can be read by the antenna unit 37 (S205) is judged. If the card contents cannot be read (ON of S205), an antenna unit that is used is changed using a timer (S206). The vehicle driver extends own hand again from the window and holds an IC card over the antenna unit 37 of the changed antenna unit (S204). When judged that the card contents can be read in Step S205 (YES of S205), the antenna unit 20 starts to make the wireless communicate with an IC card and reads fixed data of individual and variable data such as entrance data including vehicle class data and a balance of pre-paid amount recorded on the IC card (S207) and transmits these read data to the control module 28 of the traffic lane controller 29 and at the same time, displays that the system operating state is changed from the waiting state to the in-process state (S208). Further, when the card process is executed by another antenna unit, for example, the antenna unit 30, the system operation is placed in the process waiting state.

The control module 28 transmits the read result (read data), a toll computed from a vehicle class and entrance data to be collected jointly with data for discriminating an antenna unit (either the antenna units 20 and 21 or 30*a*) that is in process to the sheet processor 24 (S209).

The sheet processor 24 displays the read result and a toll to be collected and changes the processing state of that antenna unit to the in-process state from the waiting state (S210).

A clerk in-charge confirms the class of a vehicle in-process by the applicable antenna unit and the display contents and when necessary, inputs the change of an antenna unit for executing the correction and process of vehicle class, etc. (S211). Thus, the re-calculation, change of an antenna unit, etc. are processed.

When, for example, a vehicle class, etc. are corrected, the traffic lane controller 29 computes a toll to be collected again and displays a toll on the sheet processor 24.

Thereafter, a clerk in-charge checks the display content on the sheet processor 24, inputs a decided toll (S212). When a toll is decided. The control module 28 directs the applicable antenna unit 20 to record data after deducting the decided toll and the historical data of the toll collection process. The antenna unit 20 records required data on the applicable card according to this direction (S211). Further, as long as a series of toll collection process is executed, the in-process indication is displayed on the display 37 of the antenna unit 20.

When the toll collection was not normally completed, the error process is executed (S214) and the error is displayed (S215).

Further, when the toll collection was normally completed (S216), the normal completion, a using fare and an amount of balance are displayed (S217).

After the process was normally completed, the traffic lane controller 29 opens the blocking bars 27*a* and 27*b* of the start controller 27 and allows the passing of the applicable vehicle. Then, when the vehicle started and the passing of the vehicle was detected by the start detector 26, the blocking bars 27*a* and 27*b* of the start controller 27 are closed (S218). In addition, when a succeedingly entering vehicle is detected by the vehicle class discriminator 22, the traffic lane controller 29 starts to accept the processing of an IC card for a succeeding vehicle.

Figure 10:
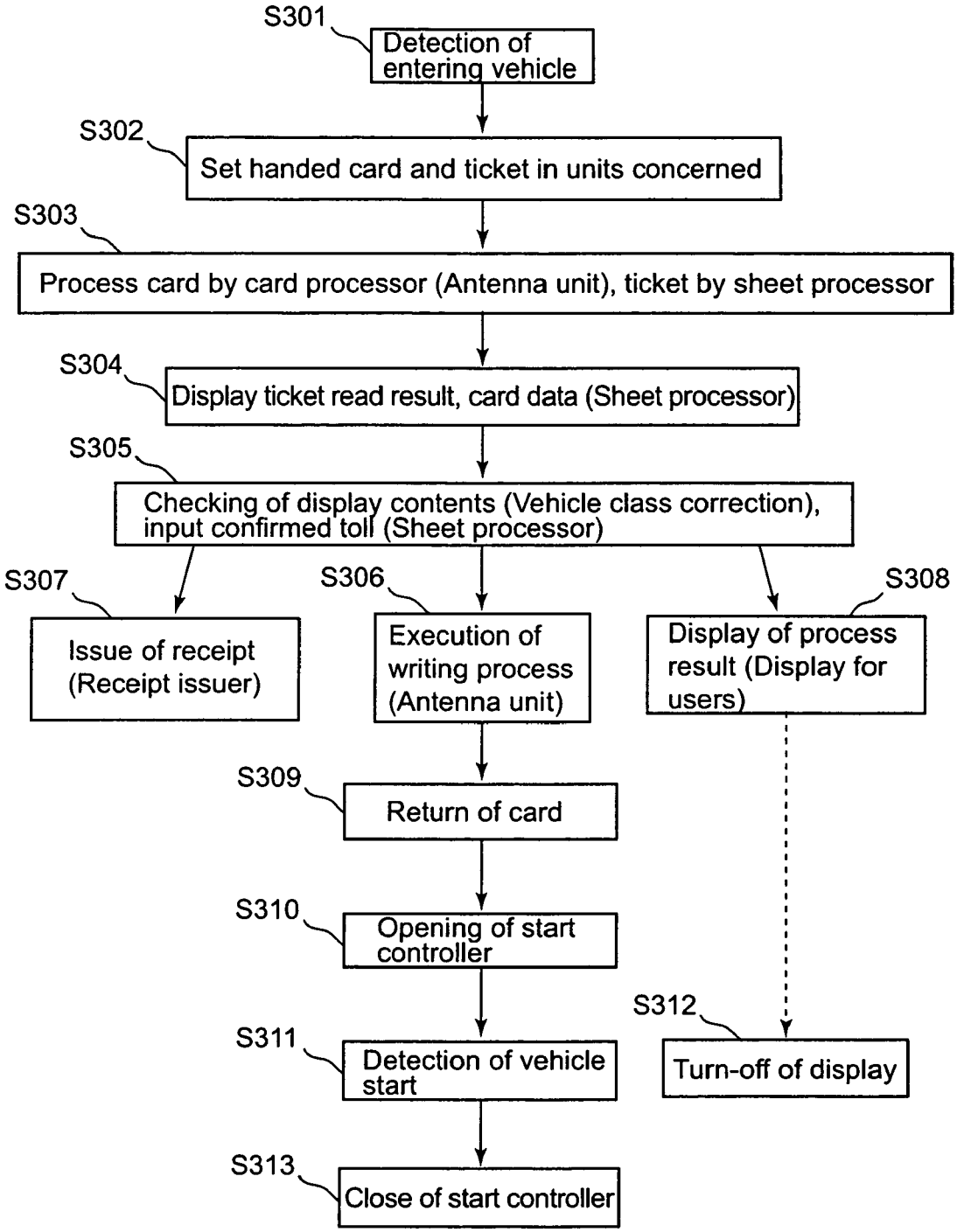
FIG. 10 is a flowchart showing the exit processing when the entrance processing is not normally completed and a passing ticket is issued.

In succession, the exit process when the entrance process was not normally completed and a passing ticket is issued will be explained referring to a flowchart shown in FIG. 10.

In this case, when the incoming of a vehicle into the exit lane is detected by the vehicle class discriminator 22 (S301), the exit process is started. A driver of a vehicle entered into the exit lane to drive the vehicle to the position of the booth 5 and stopped there hands an IC card jointly with a passing ticket to a clerk in-charge in the booth 5.

Then, the clerk in-charge inserts the passing ticket into the sheet processor 24 and the IC card into the card processor 30 incorporating the antenna unit 30*a* (S302).

As a result, each unit processes an inserted media (S303).

For example, the card processor 30 transmits the IC card data (individual card data, a balance of pre-paid amount, etc.) read by the antenna unit 30*a* to the sheet processor 24 through the control module 28 of the traffic lane controller 29, and the card contents received by the sheet controller 24 are displayed thereon. Further, the sheet processor 24 displays the read result of a passing ticket (S304).

A clerk in-charge checks the contents displayed on the sheet processor 24 (the passing ticket read result, card data, etc.), changes a vehicle class, etc. as necessary, and performs the toll decision, writing process start input process (S305).

When the finally decided toll is input by a clerk in-charge, the traffic lane controller 29 gives an instruction to all units, and the wiring process is executed by the antenna unit 30*a* (S306). Further, a toll receipt is issued from a receipt issuer (S307). In addition, after the completion of the toll collection, the normal completion, a toll and amount of balance, etc. are displayed on a display for users 23 (S308).

When the writing process is finished and the toll collection process is completed, the traffic lane controller 29 returns the card to a driver (S309) and opens the blocking bars 27*a* and 27*b* of the start controller 27 and approves the vehicle to pass the gate. Thus, when the vehicle starts and the passing of the vehicle is detected by the start detector 26 (S311), the traffic lane controller 29 directs to turn off the display on the display for user 23. The display on the display 23 is turned off (S312) according to this direction (S312). Further, the traffic lane controller 29 closes the blocking bars 27*a* and 27*b* of the start controller 27 (S313).

Figure 11:
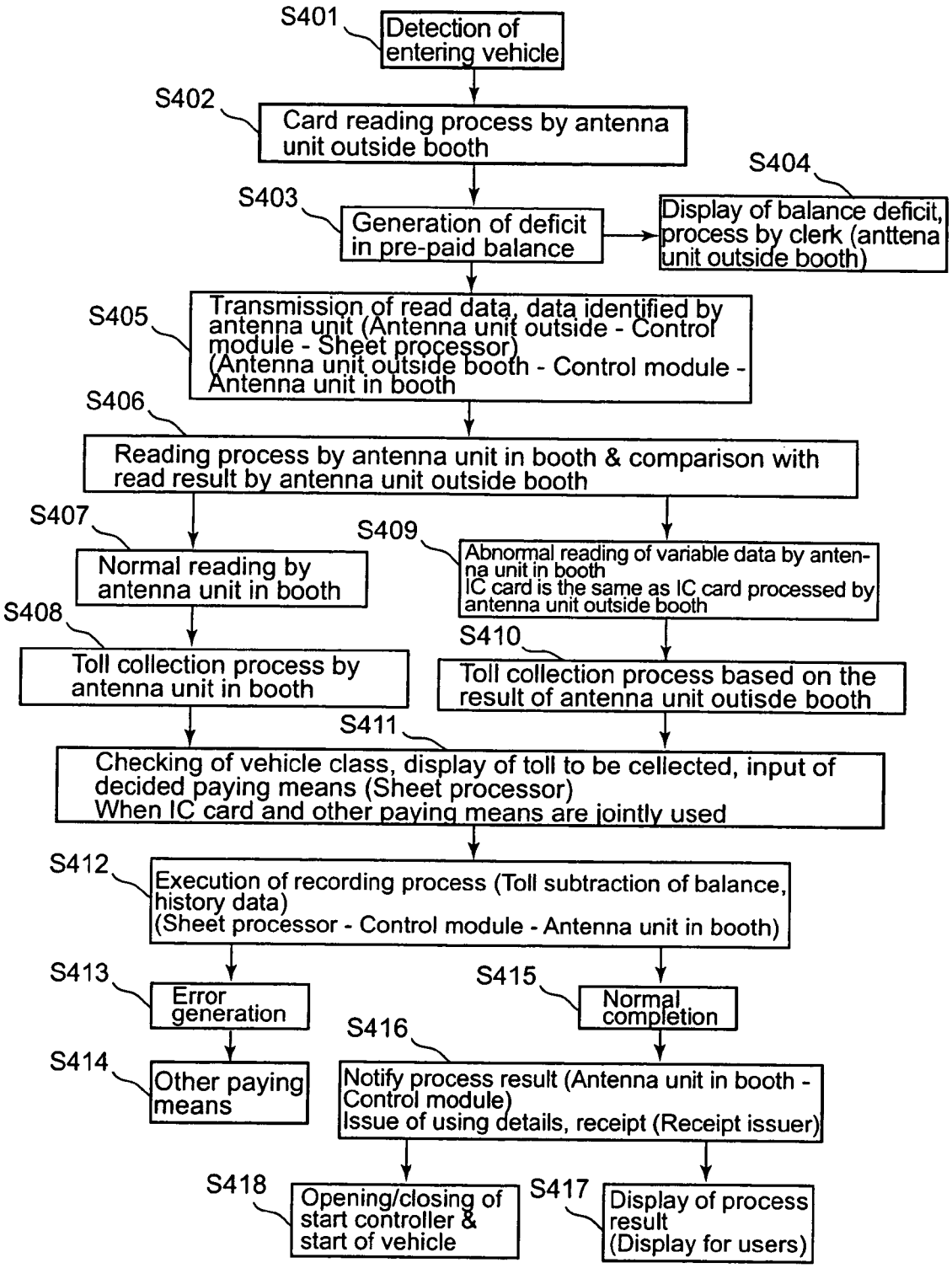
FIG. 11 is a flowchart showing the exit processing when the entrance processing is normally completed but a shortage of balance amount on a pre-paid card is generated at the exit gate.

Next, the exit process when the entrance process was normally completed but the shortage of the pre-paid balance is detected at the exit will be explained referring to a flowchart shown in FIG. 11.

When a vehicle entering into the exit lane is detected by the vehicle class discriminator 22 (S401), the traffic lane controller 29 starts the exit process.

When a driver (user) of a vehicle entering into the exit lane drives the vehicle to the position of the booth 5 and stops there and holds up an IC card over the antenna unit (either the antenna unit 20 or 21) installed outside the booth 5, the antenna unit 20 or 21 that is in the process waiting state reads data from the IC card through the wireless communication with the IC card (S402). In this case, the IC card was held up over the antenna unit 20.

When the fixed and variable data could be read properly as a result of the data read but the balance of pre-paid amount of the IC card became short (S403), the antenna unit 20 displays the deficit of the balance and displays a message to execute the process by a clerk in-charge on the applicable display 37 or the display for users 23 (S404) and notifies it to the vehicle driver, and at the same time, transmits fixed data of individual data, etc. of the IC card and variable data such as vehicle, entrance, balance amount, etc. to the control module 28 of the traffic lane controller 29 (S405).

Further, when the fixed data could be read correctly but variable data could not be read and a read error was generated, card data including the correctly read fixed data and variable data are transmitted. Further, a message showing the generation of read error is displayed on the applicable display 37 or the display for users 23.

Further, the control module 28 directs the sheet processor 24 to display the received data and a balance or the necessity for payment of separate paying media to cover the shortage, and transmits the card data of the applicable card to the antenna unit 30*a* of the card processor 30 installed in the booth 5 (S405).

Here, it is assumed that a vehicle driver who confirmed the display handed an IC card to a clerk in-charge in the booth 5 and, for example, verbally conveys a balance on the card and to pay a toll including a shortage of the balance with cash or another paying medium.

In this case, a clerk in-charge holds up the received IC card over the antenna unit 30*a* of the card processor 30 to read the IC card data (contents).

The antenna unit 30*a* compares the data read from an IC card (read results) with the results of read received from the control module 28 by the antenna unit 20 installed outside the booth 5 (S406) and checks whether individual data (Card ID, etc.) contained in both data are in accord with each other. That is, the antenna unit 30*a* checks consistency of the card data received from the control module 28 and the card data of the IC card processed by a clerk in-charge, and executes the toll collection process using the data of either one of the antenna units according to the result of this consistency check.

When, for example, card data is normally read by the antenna unit 30*a* in the booth 5 (S407), the card processor 30 executes the toll subtraction process based on the read result by the antenna unit 30*a* (S408).

On the other hand, when fixed card data (Card ID, etc.) was read correctly by the antenna unit 30*a* in the booth 5 but variable card data such as entrance data, balance amount data, etc. could not be read correctly and the abnormal reading was generated (S409), the card processor 30 executes the toll subtraction process based on the variable data of the card received from the control module 28 when the cards were confirmed to be the same card as a result of the consistency check of the card (S410).

Further, when receiving the reading result from the antenna unit 20 outside the booth, if the correctly read balance data was contained in the card data of the read result and a time is needed for the reading process from the IC card for the encryption, the card processor 30 reads first individual data only from the IC card when reading card data by the antenna unit 30*a* in the booth 5 in order to speed up the process, and checks the consistency of individual data. When the cards are the same cards, a subtractive amount is subtracted from the balance amount data already obtained from the antenna unit 20 and the short amount is collected by other paying media (cash, credit card, magnetic pre-paid card, etc.).

Further, regarding IC cards of which individual data were not in accord with each other as a result of the consistency check, the card data containing data of amount of balance is read again by the antenna unit 30*a*, a toll is determined according to individual data contained in the obtained card data and entrance data, an amount that can be subtracted is subtracted from the data of amount of balance and the shortage is to be collected by other paying media.

When checking consistency of card data, the card processor 30 checks consistency of data (fixed and variable data) by comparing data as many as possible containing in cards that could be read by two antenna units 20 and 30.

In the toll subtraction process, the card processor 30 transmits data of IC card read by the antenna unit 30*a* (individual card data, a balance of pre-paid amount, etc.) to the sheet processor 24 through the control module 28 of the traffic controller 29, and the received contents (vehicle class, toll, etc.) are displayed on the sheet processor 24.

This contents (vehicle class, toll, card data, etc.) displayed on the sheet processor 24 are checked by a clerk in-charge, a vehicle class, etc. are changed when necessary and the input operation is executed for determining a toll and a paying means (S411).

When, for example, a card balance and another paying medium such as cash, etc. are used jointly as in this case, if the decided amount is input by a clerk in-charge, the control module 28 directs the applicable antenna unit 30*a* to record data after subtracting a toll and history of the toll collection process. According to this direction, the antenna unit 30*a* records required data on the IC card (S412).

Further, when the toll collection process was not completed normally and an error was generated (S413), a toll process by other paying media is executed (S414).

When the toll collection process of the IC card was normally completed (S415), the antenna unit 30*a* of the card processor 30 notifies the result of process to the control module 28 (S416).

After completing the payment of shortage with another paying medium or a paying means, the control module 28 directs the receipt issuer 25 or the display for users 23 to issue a receipt when necessary. A detailed account (for the payment by a pre-paid card) and a receipt (for the payment with cash, etc.) are issued from the receipt issuer 25.

After completing the toll collection, the display for users 23 displays the normal completion and the process result of a toll, a balance, etc. (S417).

Further, when completing the toll collection process, the start controller 27 opens the blocking bars 27*a* and 27*b* and approves the passage of the vehicle. When the vehicle started and the start detector 26 confirmed the passing of the vehicle, the control module 28 controls the start controller 27 and closes the blocking bars 17*a* and 17*b* (S418).

Further, the above-mentioned consistency checking process was executed by the card processor 30 but may be executed by the control module.

Next, the exit process when an error was generated in the process by the antenna units 20 and 21 outside the booth 5 will be explained referring to a flowchart shown in FIG. 12.

When the vehicle class discriminator 22 detects a vehicle entering into the exit lane (S501), the traffic lane controller 29 starts the exit processing.

When a vehicle driver (a user) who drives the vehicle entered into the exit lane to the booth 5 and stopped there holds an IC card over an antenna unit (either the antenna unit 20 or the antenna unit 21) installed at the outside of the booth 5, the antenna unit 20 or 21 that is in the process waiting state reads data from the IC card (S502). In this case, the IC card was held up over the antenna unit 20.

When any error was generated as a result of this reading, the antenna unit 20, after executing the re-process by limiting to the reading of the individual data of IC card and the entrance data (S503), displays a request to a vehicle driver (a user) to hand the IC card over to a clerk in-charge on the display 37 (S504), and transmits data relative to the data that could be read properly out of the IC card data and error contents to the control module 28 (S505).

The control module 28 displays the received data and another paying means for the sheet processor 24 and at the same time, transmits the received data to the antenna unit 30*a*. A clerk in-charge executes the toll collection process using the antenna unit 30*a* of the card processor 30 in the booth 5. At this time, the card processor 30 compares the data read by the antenna unit 30*a* from an IC card (a read result) with the read result by the antenna unit outside the booth 5 received from the control module 28 (S506) to check whether the card data (the card ID, etc.) are in accord with each other. That is, the card processor 30 checks the consistency of the card data of the antenna unit 20 outside the booth received from the control module 28 with the card processed by the antenna unit 30*a*. According to the result of the consistency check, the toll collection process is executed using data of the antenna unit (either the antenna unit 20 or the antenna unit 30*a*).

In the comparison check, the read result of IC card data by the antenna units 20 and 20*a* for right and wrong (S506).

Then, when the IC card data read result y the antenna units 20 and 30*a* is right (READ OK of S506), the toll collection process is executed using the antenna unit 30*a* in the booth 5 (S507).

Further, when the IC card data read result by the antenna units 20 and 30*a* is wrong (READ NG of S506), the card processor 30 checks whether the IC cards read by the different antenna units 20 and 30*a* are the same card and the entrance data of the IC card could be normally read by the antenna unit 20 outside the booth 5 (S508).

When, for example, the entrance data could be read normally by the antenna unit 20 as a result of this checking result (YES of S508), the toll collection process is executed based on the read result by the antenna unit 20 outside the booth 5 (S509).

Further, when, for example, the entrance data could not be read normally by the antenna unit 20 as a result of the above checking (NO of S508), the data reading process from an IC card is executed again by the antenna unit 30*a* in the booth 5. Then, when the entrance data could not be read even in this re-reading process (NO of S11), the toll collection process is judged to be executed by a management office in a toll house because the process at the exit lane is not possible (S512) and this judgment is transmitted to the sheet processor 24 and so displayed. Further, when the entrance data could be read normally in this re-reading process (YES of S511) or when the entrance data could be read but the toll subtraction process could not be executed, the card processor 30 specifies an entrance toll house based on the read result by the antenna unit 30*a*, computes a toll and collects the toll by another paying means.

On the other hand, when the IC card could not be processed properly even in the antenna unit 30*a* of the card processor 30 in the booth 5 but when the entrance data of the IC card could be confirmed from the result of consistency check of the IC card displayed on the sheet processor 24, the toll collection process (the toll subtraction process) is executed in the antenna unit 30*a*.

In the toll collection process, the card processor 30 transmits data of the IC card read in the antenna unit 30*a* (card individual data, pre-paid balance, etc.) to the sheet processor 24 through the control module 28 of the traffic lane controller 29 and the received card contents (vehicle class, toll, etc.) are displayed on the sheet processor 24.

A clerk in-charge checks the contents (vehicle class, toll, card data, etc.) displayed on the sheet processor 24, changes a vehicle class as necessary and performs the inputs operation for deciding a toll and a paying means (S513).

When the confirmation was input by a clerk in-charge in the case where a balance of an IC card and other paying means including cash are jointly used, the control module directs the pertinent antenna unit 30*a* to record the data after subtracting a toll and the history data of the toll collection process. The antenna unit 30*a* records the required data on the applicable IC card (S514).

Further, when the toll collection process was not normally completed and an error was generated (S515), the toll collection is processed with another paying means (S516).

When the toll collection process with the pertinent IC card was normally completed (S517), the antenna unit 30*a* of the card processor 30 notifies the processing result to the control module 28 (S518).

After completing the payment of a deficit of a toll by another paying means, the control module 28 directs the receipt issuer 25 and the display for users 23 to issue a document. According to this direction, a using details (for the payment by a pre-paid card) and a receipt (for the payment of cash, etc.) are issued from the receipt issuer 25.

After completing the toll collection, the display for users 23 displays the normal completion of the toll collection and the result of process of a used toll, a balance of amount, etc. (S519).

Further, when the toll collection process was completed, the start controller 27 opens the blocking bars 27*a* and 27*b* and allows the passage of the vehicle. Then, at the time when a vehicle started and the passage of the vehicle was confirmed by the start detector 26, the control module 28 controls the start controller 27 to close the blocking bars 27*a* and 27*b* (S520).

Figure 13:
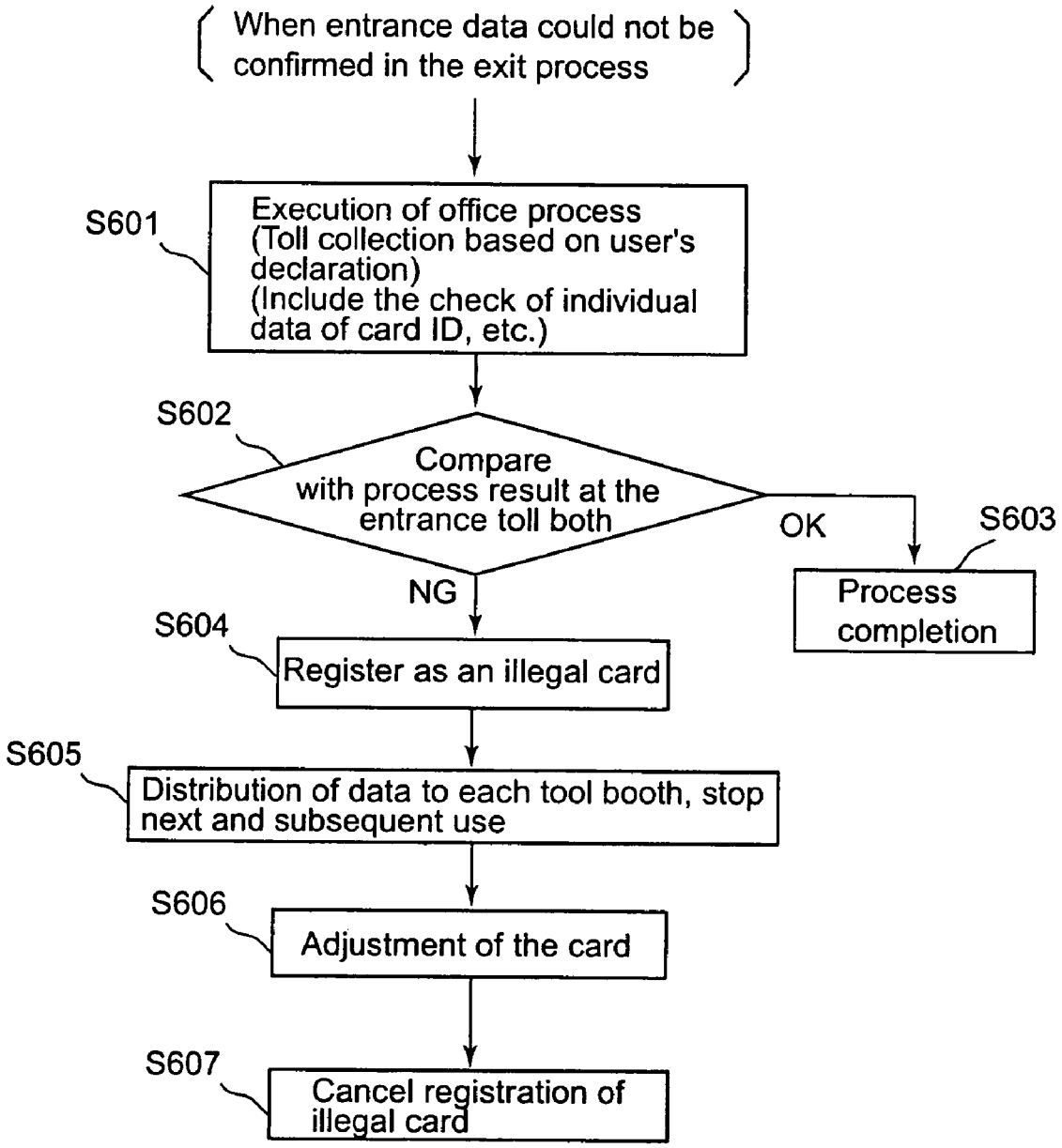
FIG. 13 is a flowchart showing the exit processing when the entrance data could not be confirmed at the exit gate.

Next, the process at the exit when the entrance data could not confirm will be explained referring to a flowchart shown in FIG. 13. FIG. 13 is the flowchart showing the exit process when the entrance data could not be confirmed.

Figure 12:
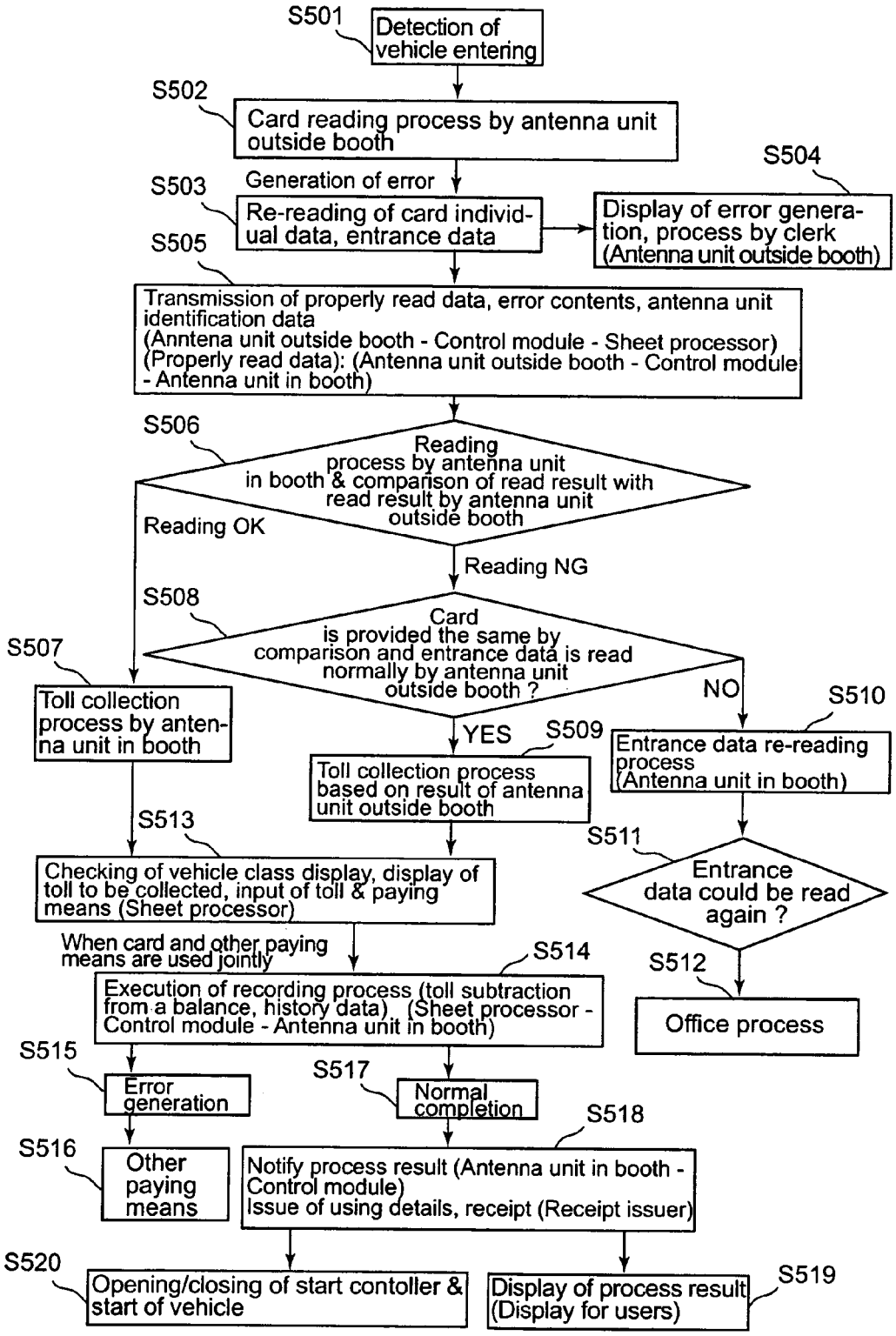
FIG. 12 is a flowchart showing the toll collection process when an error is caused when an external antenna unit is used.

When the entrance data could not be confirmed at the time of the exit processing, it becomes the office process shown in S512 of the flowchart shown in FIG. 12.

In the office process, the toll collection is executed based on the declaration by a user (S601). Further, the checking of individual data of card ID, etc. is included in this process.

The result of the office process of the IC card is transmitted to the higher rank apparatus 9 in the center. Further, the processing result at the entrance booth is transmitted to the higher rank apparatus 9. Therefore, the higher rank apparatus 9 collates the processing result at the entrance booth with the process result for the IC card in the office process (S602).

When both process results are in accord with each other as a result of this collation (OK of S602), the process is completed.

On the other hand, when any difference was recognized between both process results (NG of S602), it is regarded that a user made a false declaration in the office process, and the higher rank apparatus 9 registers the data of such an IC card as an illegal card (S604) and distributes the registered data to the traffic lane controllers 19 and 29 at each entrance or exit toll house of a toll road, and suspends the next and subsequent uses (S605).

When a user of that IC card visited any entrance toll house of a toll road and tried to enter into the entrance lane, the entrance into the entrance lane is regarded an error, and when the shortage of the toll was adjusted by a clerk in-charge (S606), that data is transmitted to the higher rank apparatus in the center from the traffic controller 19 of the entrance toll house and the illegal card registration is cancelled in the higher rank apparatus (S607).

Figure 14:
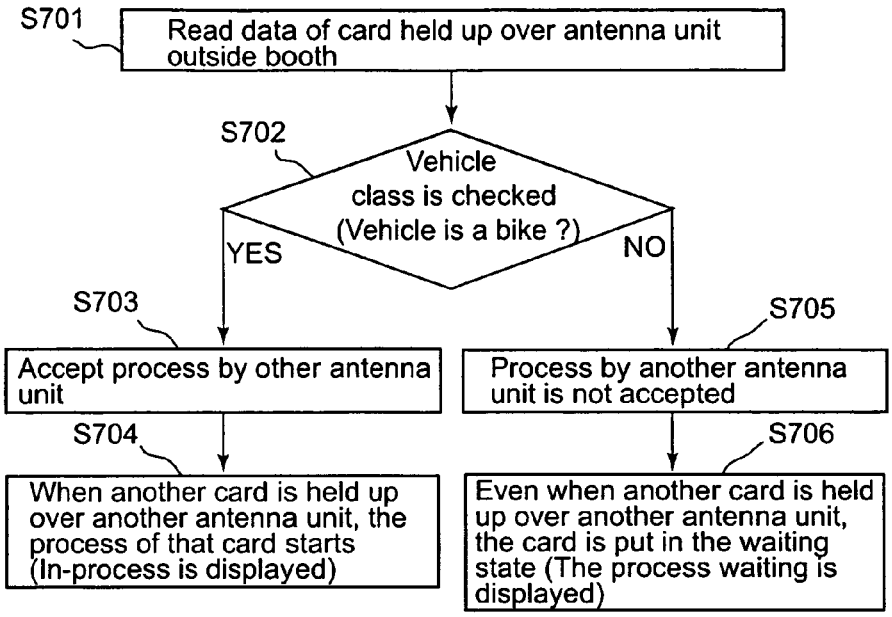
FIG. 14 is a flowchart showing the processing of plural antenna units installed outside booth at the exit gate.

The processes of plural antenna units 20 and 21 installed outside the booth 5 of the exit lane will be explained referring to a flowchart shown in FIG. 14. FIG. 14 is a flowchart showing the processes of plural antenna units installed at the outside of the exit.

In this case, the antenna unit 20 or 21 installed at the outside of the booth 5 reads data recorded in an IC card that is held up over it (S701).

For example, when the antenna unit 20 or 21 reads a vehicle data from an IC card, the antenna unit 20 passes the read vehicle class data to the traffic lane controller 29, which in turn confirms the vehicle class (S702).

When the IC card was judged for a two-wheeled vehicle (hereinafter, referred to as a bike)(YES of S702) as a result of the vehicle class checking, the traffic lane controller 29 executes the accepting process of other cards that are held up over other antenna units 21 and 30*a* (S703).

On the other hand, when the IC card is judged to be a card for a vehicle other than a bike (a four-wheeled vehicle, etc.) as a result of the vehicle class checking (NO of S702), the traffic lane controller 29 does not accept the process of another antenna unit until the process of the first card is completed (S705) and even when another card is held up over another antenna unit, does not execute the process of another card and is kept in the waiting state for the process (S706).

As a result, while the IC card of a bike first entered into the lane is being processed, this bike will not be left behind a four-wheeled vehicle entering into the lane successively and the generation of accident of contact or collision in the lane can be prevented.

Figure 15:
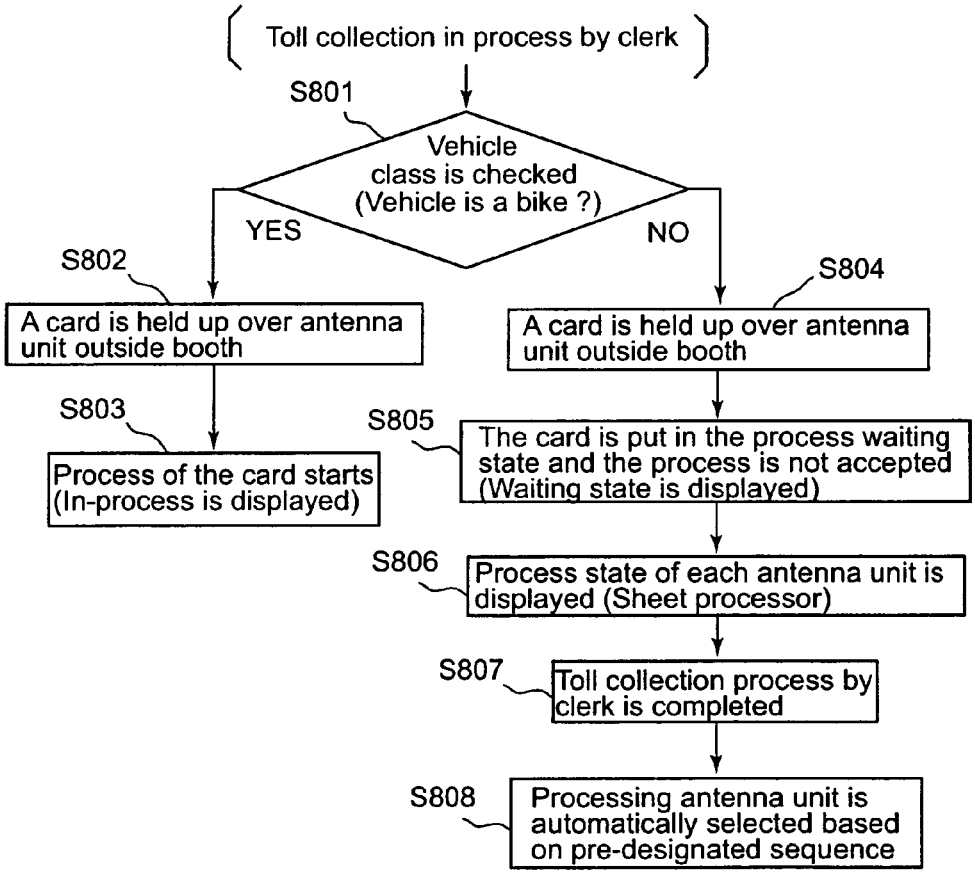
FIG. 15 is a flowchart showing the processing by the antenna unit in booth during the toll collection process by a clerk in the exit processing.

The toll collection process using an antenna unit outside the booth by a clerk in-charge will be explained referring to a flowchart in FIG. 15. Shown in FIG. 15 is the flowchart showing the process of an antenna unit installed outside booth in the toll collection process by a clerk in-charger at the exit.

When a new vehicle enters into the exit lane while the toll collection process is being executed by a clerk in-charge for a vehicle (a bike or a vehicle other than a bike, for example, a four-wheeled vehicle) in the booth 5, the newly entering vehicle is detected and a vehicle class is discriminated by the vehicle class discriminator 22 (S801).

According to the result of the vehicle class discrimination of this succeeding vehicle, the control module 28 of the traffic lane controller 29 judges whether the process for the succeeding vehicle should be kept waited or started regardless of a class of a preceding vehicle that is in process.

For example, when a vehicle that is in process for a toll collection by a clerk in the booth 5 is a bike and a vehicle entering subsequently is also a bike (YES of S801) as a result of the vehicle discrimination, a bike driver (a user) stops the bike at the position of the empty antenna unit 21 and holds up an IC card over the antenna portion 36 of the antenna unit 21 (S802).

In this case, a risk for collision between the preceding bike and the succeeding bike is less, the control module 28 of the traffic lane controller 29 places the antenna unit 21 in the state able to execute the process. The IC card data is read by the antenna unit 21 and passed to the traffic lane controller 29, and the process of the IC card is started (S803).

On the other hand, when a vehicle that is being processed for the toll collection by a clerk in-charge in the booth 5 is a bike and a entering vehicle is a vehicle other than a bike (NO of S801) and, for example, a left handle vehicle as a result of the vehicle class discrimination, a left handle vehicle driver (a user) stops the vehicle at the position of the empty antenna unit 21 and holds up an IC card over the antenna portion 36 of the antenna unit 21 (S804).

Thus, when the preceding vehicle is a bike and a succeeding vehicle is a vehicle other than a bike, even if an IC card is held up over the antenna unit 21 (20) outside the booth 5, the control module 28 of the traffic lane controller 29 is kept in the process waiting state and does not accept the process of the held up IC card (S805).

Further, if a four-wheel vehicle enters into the lane when the preceding vehicle is a four-wheeled vehicle, the side by side traveling of four-wheeled vehicles is normally not feasible for the limited width of the traffic lane and the succeeding vehicle has to wait until the process of the preceding vehicle is completed. When a bike enters into the lane as a succeeding vehicle when a preceding vehicle is a four-wheeled vehicle, the process is started when a bike driver (a user) holds up an IC card over an empty antenna unit as a result of the above-mentioned judging process in S801.

Further, as long as when the toll collection process is executed by a clerk in-charge for a bike having a narrow vehicle width, the process of an IC card may be executed when the IC card is held up over the antenna unit 20 or the antenna unit 21.

The state of the antenna units 20, 21 and 30 is displayed on the sheet processor 24 and at the same time, the processing state of the antenna units 20 and 21 showing whether they are in the toll collection process or waiting the process is displayed on the display 37 (S806).

When the toll collection process by a clerk in-charge was completed (S807), the control module 28 of the traffic lane controller 29 selects an antenna unit that executes the process next or the antenna portion 36 automatically according to a pre-set sequence such as the time series, etc. (S808).

Figure 16:
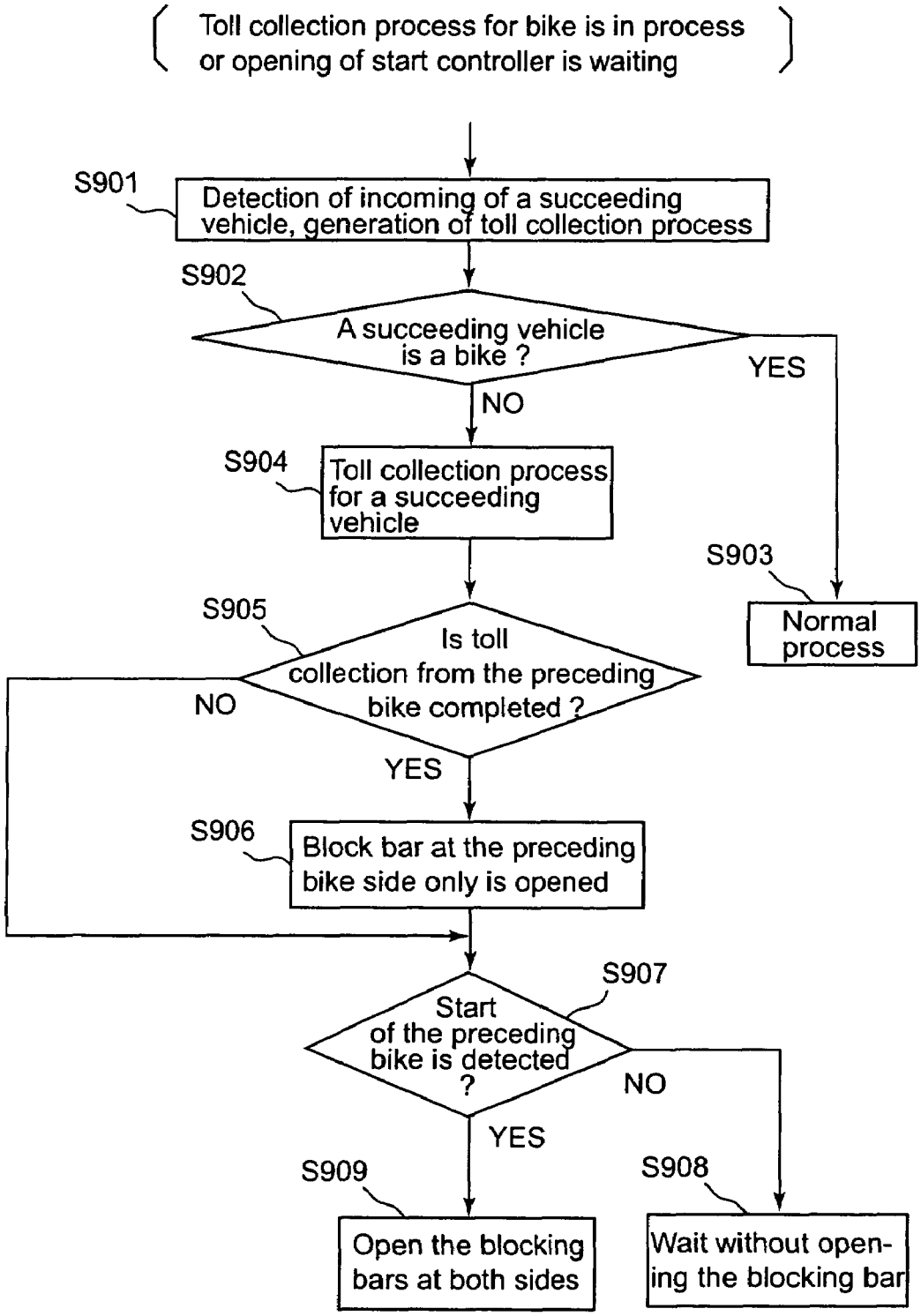
FIG. 16 is a flowchart showing the start control operation for a auto-bicycle and a succeeding vehicle.

The start control operation for a bike and a succeeding vehicle will be explained referring to a flowchart shown in FIG. 16. FIG. 16 is a flowchart showing the start control operation for a bike and a succeeding vehicle.

In this case, the system is in such a structure that the antenna units 20 and 21 outside the booth 5 are installed at both sides of the traffic lane, and the start controller 27 has the blocking bars 27*a* and 27*b* in the half length of the vehicle width installed at both sides of the traffic lane.

At the exit lane in the construction as described above, when a succeeding vehicle entering into the traffic lane was detected by the vehicle class discriminator during the toll collection process of, for example, a bike or in the state waiting the open of the start controller 27 after completing the toll collection, or when another toll collection process was newly generated (S901), the control module 28 of the traffic lane controller 29 judges a class of the vehicle that becomes an object for the newly generated toll collection process (S902).

When the vehicle class subject to the new toll collection process was, for example, a bike as a result of the vehicle class judgment (YES of S902) (including the ETC process newly generated when this system is provided to, for example, an ETC lane), even if a vehicle in the preceding process is a bike, the ordinary process is executed because a risk for collision is less (S903). The ordinary process is that process shown in FIG. 15 or FIG. 14.

Further, when the vehicle class that is a newly generated object for the toll collection process is, for example, a vehicle other than a bike (NO of S902), the processing state of the preceding bike is checked (S905) while executing the toll collection process for the succeeding vehicle (S904).

Then, when the toll collection process for a preceding bike was completed (YES of S905), the control module 28 of the traffic lane controller 29 opens only the blocking bar at the side where the antenna unit processed the bike (when the antenna unit 20 processed the bike, the blocking bar 27*a* at the side of the booth 5) (S906). Further, the side where the antenna unit that processed the bike indicates either left or right side of the lane to the traveling direction of a vehicle and normally it becomes the booth side when the toll collection by a clerk in-charge is newly generated.

Further, even when the toll collection process for a succeeding vehicle was completed but the process for a preceding vehicle is not completed (NO of S905), the control module 28 of the traffic lane controller 29 does not open the blocking bars 27*a* and 27*b* and keep them closed (S908) as long as the start of the preceding bike is not detected by the start detector 26 (S907) and opens the blocking bars 27*a* and 27*b* at both sides only when the start of the preceding bike is detected by the start detector 26 (S909). Even when the toll collection process was completed for the succeeding vehicle, the blocking bars 27*a* and 27*b* of the start controller 27 are not opened until the start and passing of the bike is detected and confirmed by the start detector 26.

That is, when a processed vehicle is a two-wheeled vehicle and a succeeding vehicle entered into the traffic lane is other than a two-wheeled vehicle, the control module 28 of the traffic lane controller 29 allows the processed succeeding vehicle to leave the traffic lane after allowing the processed two-wheeled vehicle first to leave the traffic lane and therefore, there will be no such accidents as a succeeding vehicle finishes the process first and collides with a preceding two-wheeled vehicle or contact accident when passing the two-wheeled vehicle.

Further, in this system, the blocking bars of the start controller 27 are opened/closed at a preset time elapse for every vehicle class decided as a result of the toll collection process. In particular, when a vehicle is a bike, a much time is generally needed for starting and the control module 28 of the traffic lane controller 29 starts the opening/closing operation of the start controller 27 after waiting a much time more than other vehicles (four-wheeled vehicles) after completing the toll collection process.

In other words, the control module 28 of the traffic lane controller 29 controls the timing to approve the passage of a vehicle leaving the exit lane. When a vehicle that finished the IC card process is a two-wheeled vehicle, a much time is needed for starting to leave the exit lane and the timing to approve the passage of a vehicle is made slower than a four-wheeled vehicle. Thus, a driver (a user) of a two-wheeled vehicle is enabled to start a vehicle not abruptly.

Thus, according to the toll collection system in this embodiment, at least the antenna units 10 and 11 are arranged at the entrance lane of a toll road for executing the card process through the wireless communication by closing (holding up) or touching a wireless type pre-paid IC card to them and at least the antenna units 20 and 21 are arranged at the exit lane of a toll road for executing the card process through the wireless communication by closing or touching the IC card. At the same time, the antenna unit 30*a* is provided in the booth 5 of the exit lane for coping with errors generated on the antenna units 20 and 21. Therefore, by minimizing the dealings with a clerk in-charge at the exit lane, making a processing time short, enabling the IC card processing even in the booth 5 and certainly executing the toll collection process, a toll collection system with the enhanced convenience of users can be achieved as a result.

Further, the antenna units 20 and 21 at the left and right sides of the traffic lane are selectable according to a vehicle class. In addition, for the antenna unit 20, the antenna portion 36 provided at the upper, middle and lower stages can be used selectively. Accordingly, it becomes possible to hold up an IC card over the antenna portion 36 in a height suited for use by users. Thus, a toll collection system with a processing time reduced and convenience of users improved can be realized.

As the antenna units 20 and 21 are arranged at the left and right sides of the exit lane, the exchange of IC cards, cash, etc. normally made between users and a clerk in-charge at the exit lane are eliminated, a processing time can be made short. Further, as the antenna unit 30*a* is provided in the booth 5, when a balance of pre-paid amount becomes short or any abnormality is taken place during the exit process, a clerk in-charge in the boot 5 is enabled to execute the toll collection process quickly and certainly.

If a balance of pre-paid amount became short when paying a toll with an IC card, the shortage of the balance on the IC card is made payable by other paying means and therefore, the same usability as a magnetic type pre-paid card is assured.

Further, when an IC card was held up over the antenna unit 20 or 21 installed outside the booth 5 and the reading became abnormal, that IC card is read by the antenna unit 30*a* of the card processor installed in the booth 5. The toll subtraction process is made by the card processor 30 based on the read results of both antenna units. Therefore, for example, when an antenna unit could read fixed data properly but couldn't read such variable data as the entrance data, a balance of pre-paid amount, etc., the toll subtraction process can be executed using data from the card data read result of other antenna unit as supplementary data. Accordingly, even when the card data could not be read properly, the efficient toll collection process can be executed.

As the antenna units 20 and 21 are arranged at both sides of the exit lane, the toll collection process at the exit lane for a bike that required the most much time at present can be performed efficiently.

Further, when vehicles are entering successively in the exit lane or the entrance lane, the process by the antenna units 10 and 11 and the antenna units 20 and 21 are so controlled as to waiting or start according to a preceding or succeeding vehicle class. Therefore, the toll collection can be made efficiently while assuring the safety.

For example, when a preceding vehicle is a bike and a succeeding vehicle is a four-wheel vehicle, the process of the four-wheeled vehicle is kept waiting until the process of the bike is completed. Thus, an accident of the four-wheeled vehicle that completed before the bike to contact the bike when passing it can be prevented. In addition, when a succeeding vehicle is a bike, the empty antenna unit (the antenna unit 20, 21 or 30) is able to execute the process regardless of a class of a preceding vehicle in the exit lane and thus, the toll collection process for vehicles can be efficiently executed.

That is, it becomes possible to introduce a wireless type pre-paid IC card system into a toll road. This system is capable of the toll collection process for bikes traveling side by side combining the safety avoiding the risk accompanied with the overtaking of a bike by a four-wheeled vehicle and the process efficiency.

Further, the antenna unit 30*a* is provided in the booth 5 and two antenna units 20 and 21 are installed outside the booth 5. When two bikes are coming into the lane side by side while a clerk in-charge is executing the toll collection process for a preceding vehicle, the toll collection can be executed in parallel and thus, the process efficiency can be improved.

A start controller having the blocking bars 27*a* and 27*b* opening outward to the left and right is installed at the exit lane. Only the blocking bar at the antenna unit that processed a bike is opened/closed. Thus, it becomes possible to execute the efficient toll collection securing the safety of a bike to start and travel by preventing a succeeding bike first processed from colliding with a bike and enabling bikes to travel side by side.

When a vehicle of which toll collection process is completed is a two-wheeled vehicle, a driver of that vehicle will become ready to start without being impatient when an opening/closing timing of the blocking bars 27*a* and 27*b* of the start controller 27 is made slower than that for four-wheeled vehicles and it becomes possible to promote the safety in the traffic lane.

That is, according to the toll collection system in this embodiment, when a non-contact (a wireless type) pre-paid IC card system improving the security by taking over usability of anonymous, unlimited and disposable that is used as one of toll collection means of a toll collection system of toll road into toll roads without impeding the operation of the current toll collection system, it is possible to promote the services to users.

Further, the present invention is not limited to the embodiment described above.

In the above-mentioned embodiment, the blocking bars 27*a* and 27*b* opening to the left and right are exemplified but the same start control as in the above-mentioned embodiment can be achieved when two units of start controllers are arranged at one side only of the roadside of the traffic lane, a blocking bar for longer traffic wide vehicles is attached to one unit and a blocking bar for two-wheeled vehicle in a width half of the traffic lane is attached to another unit and the either one of the blocking bar of the start controller is opened/closed according to a vehicle class.

Further, in the above-mentioned embodiment, the payment by a wireless type IC card only, and the payment of combined use of IC card and cash, etc. are mainly described but the mixture of IC cards for the ETC system or the common use may be possible.

Next, a second embodiment of the present invention will be explained.

Figure 17:
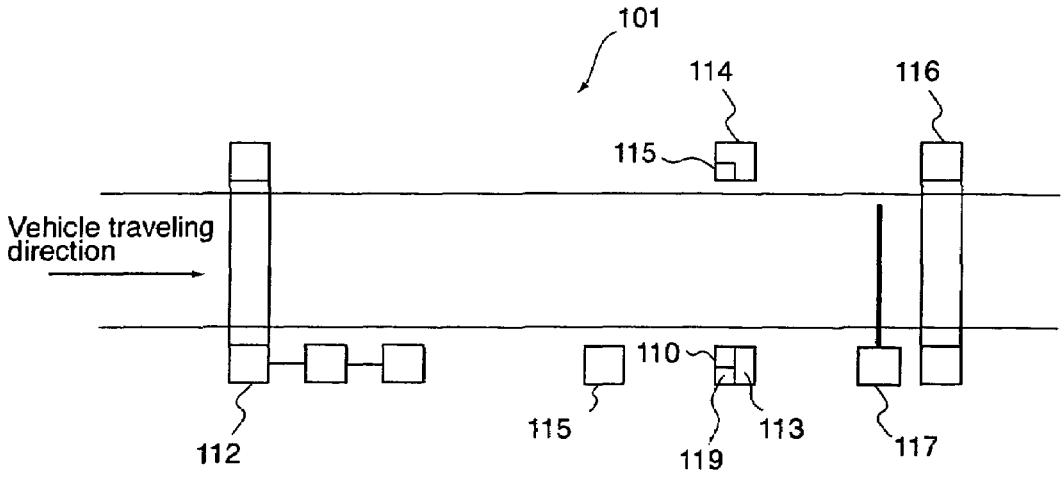
FIG. 17 us a block diagram showing the layout of equipment of the entrance system in an second embodiment of the present invention.

An entrance system 101 is composed of an antenna unit 110, an antenna unit 111, a vehicle class discriminator 112, a passing ticket issuer 113, a passing ticket issuer for left handle vehicle 114 (hereinafter, called as a ticket issuer for left handle vehicle), a roadside display 115, a start detector 116, a start controller 117 and a traffic lane controller 119 as shown in FIG. 17.

The antenna unit 110 is arranged at a position of the roadside (the right side in the vehicle traveling direction) to which a driver who once stopped a vehicle entered into the traffic lane can reach by extending the hand through the window. When a non-contact IC type pre-paid card (hereinafter, called as IC card) that is a wireless type pre-paid IC card is brought close to a prescribed range from an antenna portion 146 that is an first antenna unit provided at the upper, middle and lower stages as shown in FIG. 18, card data are obtained from the IC card through the wireless communication and when the card data are normal, vehicle data, vehicle class data and entrance data are recorded on the IC card through the wireless communication (non-contact). The prescribed range referred to above is a range within, for example, several 10 cm differing from the communication range of the ETC on board unit. To bring an IC card includes such a deed to touch or hold up an IC card to or over an antenna unit.

The IC card stored card individual data such as Card ID No. (fixed data) and such variable data as pre-paid amount (a balance) data, using history data, etc. in an IC chip built in the card as card data. In the using history data, vehicle data including the specified Number Plate No. of a vehicle, discriminated vehicle class, entrance data, etc. in the entrance process are contained. Further, on the surface of the card, Card ID No. is printed so that this IC card can be visually specified.

The antenna unit 111 is arranged at the position (the left side in the vehicle traveling direction) of the roadside almost opposing to the antenna unit 110 through the traffic lane. The card data is obtained from the IC card that is held up over the antenna portion 146 that is a second antenna unit provided through the wireless communication and when the card data is normal, vehicle data, vehicle class data and entrance data are recorded on the IC card through the wireless communication (non-contact). The vehicle class discriminator 112 detects a vehicle entering into the traffic lane and obtains such vehicle data as the number of axles, height, length, number plate, etc. of the entering vehicle and discriminates the vehicle class from the obtained vehicle data. The vehicle class referred to here is a kind of vehicle classified at the operating side of a toll road for the purpose of toll collection and, for example, a large type, a large special type, medium, small and light vehicles. The passing ticket issuer 113 issues a passing ticket according to a class of an entering vehicle when the entrance process was normally completed for generation of error in the entrance process of IC cards. The passing ticket issuer for left handle vehicles 114 is arranged at the position of the roadside almost opposing to the passing ticket issuer 113 through the traffic lane and issues a passing ticket to a left handle vehicle driver. The roadside display 115 displays the processing state and the leading contents and notifies the leading contents to a vehicle driver. The start detector 116 detect a vehicle started and left from the traffic lane after receiving a passing ticket by a vehicle driver or completing the entrance process by an IC card. The start controller 117 approves or blocks the passing of a vehicle according to the result of the entrance process. The traffic lane controller 119 is connected to various equipment including the antenna units 110 and 111 through the communication circuits, obtains data from respective equipment and controls various processes (the entrance process, etc.) relative to the use of a toll road and controls the roadside equipment (controls to make the card processing function of the antenna units 110 and 111 valid/invalid, the opening/closing of the start controller 117, etc.).

Figure 18A:
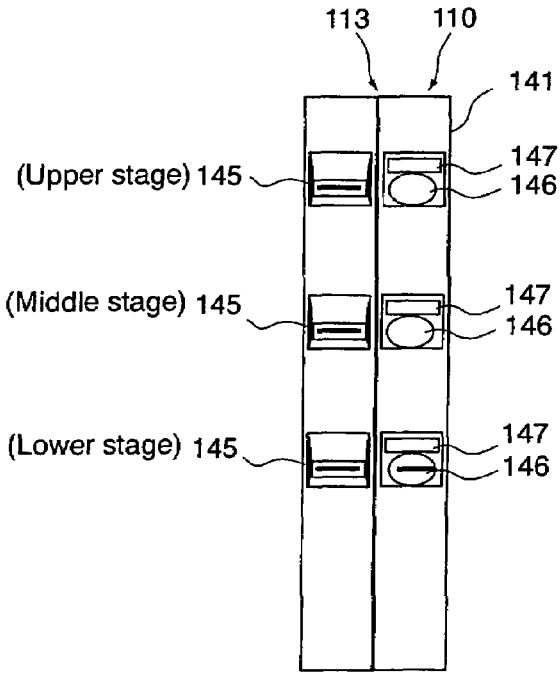
FIG. 18A is a front view of a passing ticket issuer and an antenna unit provided at an entrance.

The passing ticket issuer 113 is provided with plural ticket issuing units 145 in the vertical direction (at different heights) as shown in FIG. 18A. These plural ticket issuing units 145 of the passing ticket issuer 113 are called as the first passing ticket units. Each of the ticket issuing units 145 has a function to issue a passing ticket under the control of the traffic lane controller 119 and evacuate the issued ticket temporarily when occasion demands and thereafter, completely store or re-issue. "When occasion demands" indicates when an IC card is held up over any antenna portion 146 or when the process of the IC card held up over the antenna portion 146 was not normally completed.

The antenna unit 110 has a bar-shaped main body 141 erected at the right roadside of the traffic lane. In the main body 141, an antenna portion 146 and a display 147 are provided at the upper, middle and lower stages, respectively. The antenna portion 146 and the display 147 at the upper stage are for a vehicle having relatively higher seats such as a large type vehicle, bus, etc. The antenna portion 146 and the display 147 at the middle stage are for vehicles having a height of residential vehicle, etc. The antenna portion 146 and the display 147 at the lower stage are for vehicles having relatively lower seats such as passenger vehicles, light vehicles, bikes, etc. The display 147 lights, blinks or displays messages when the card processing function (the wireless communication function) of the antenna portion 146 selected by the traffic lane controller 119. A message that is displayed is such that, for example, "Please hold up an IC card over this position." or "Please wait a little until the process of a preceding vehicle is finished."

Figure 18B:
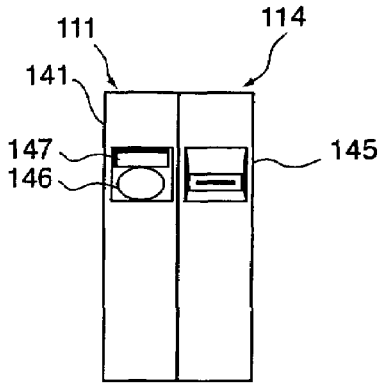
FIG. 18B is a front view of a passing ticket issuer for left handle vehicles at an entrance.

The passing ticket issuer for left handle vehicle 114 is provided with a ticket issuing unit 145 at the same height as the ticket issuing unit 145 at the lower stage of the passing ticket issuer 113 as shown in FIG. 18B. The ticket issuing unit 145 of the passing ticket issuer for left handle vehicle 114 is called as a second passing ticket issuer. The ticket issuing unit 145 has the functions to issue a passing ticket under the control of the traffic lane controller 119, evacuate the issued ticket temporarily and thereafter, completely store or re-issue when occasion demands. The antenna unit 111 has bar-shaped main body 141 erected at the left roadside of the traffic lane. The main body 141 is provided with the antenna portion 146 and the display 147 at the position of the same height as the lower stage of the antenna unit 110. The antenna portion 146 and the display 147 are arranged at the position to which a left handle vehicle driver is able to reach by extending the hand through the window. The display 147 lights, blinks or displays a message when the card processing function (the wireless communication function) of the antenna portion 146 is valid.

That is, the ticket issuing units 145 of the passing ticket issuer 113 and the antenna portions 146 of the antenna unit 110 are corresponding to each other and arranged at the close positions, and the ticket issuing units 145 of the passing ticket issuer for left handle vehicle and the antenna portions 146 are corresponding to each other and arranged at the close position.

In the case of the communication of LAN, the corresponding relation between respective ticket issuing units 145 and the antenna portions 146 is managed by an address control table. In addition, the corresponding relation may be managed by dividing the system of communication circuits and by physical wiring.

Figure 19:
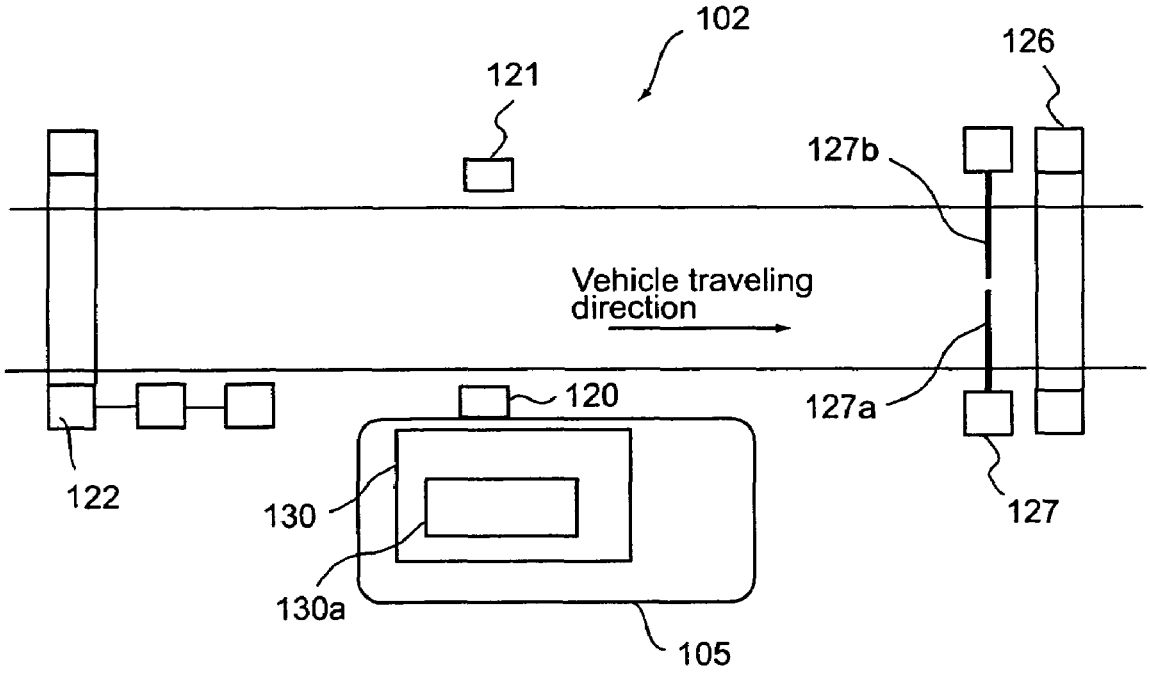
FIG. 19 is a schematic diagram showing the layout of equipment of an exit system.

The exit system 102 is composed of antenna units 120 and 121, a vehicle class discriminator 122, a display for users to display the IC card processing state (a subtracting amount, a balance after subtraction) and urge to insert a card that is an object of process, a sheet processor 124 for processing passing tickets, etc., making the display for a clerk in-charge and the input operation by a clerk in-charge, a receipt issuer 125, a start detector 126, a start controller 127, a card processor 130 incorporating an wireless communication means such as an antenna unit 130*a*, etc. and a traffic lane controller 129 having a built-in control module 128 that executes the toll collection process by obtaining IC card data through the antenna unit 130*a* of the card processor 130 and controls roadside apparatus as shown in FIG. 19. The vehicle class discriminator 22 detects a vehicle passed through a toll road and entered into the exit traffic lane (a vehicle leaving a toll road), obtains such vehicle data as the number of axles, height, length, the number plate and discriminates its class from the obtained vehicle data. The vehicle class referred to here is a class of vehicle divided by the toll road administration side for the toll collection, for example, large type, large special type, medium type, small type, light vehicle, etc. The card processor 130 is provided with an antenna unit 130*a* that reads IC card data when an IC card is held up over or touched it and writes the processing result into the IC card. Further, the antenna unit 130*a* is in the same specifications as the antenna portions 136 and 146 described above and executes the data reading, writing and verification processes of IC card data for an IC chip through the resonance of the transmitted radio waves and an IC card side antenna. The control module 128 of the traffic lane controller 129 is a memory and stores a control program for executing the process relative to IC card and vehicle and the control of apparatus in the booth 105 or roadside apparatus. Further, the control module 128 itself can be a software. The traffic lane controller 129 executes the process of the control module 128 and controls various processes relative to use of a toll road (the exit process, etc.) and the apparatus described above. The control module 128 stores the exit data (the toll house number, lane number, toll data with another toll house, etc.) in advance. The control module 128 (or the sheet processor 124, etc.) computes and collects a toll (a using charge) from an IC card of a vehicle leaving a toll road or the entrance and exit data stored (recorded) in a passing ticket.

Figure 20:
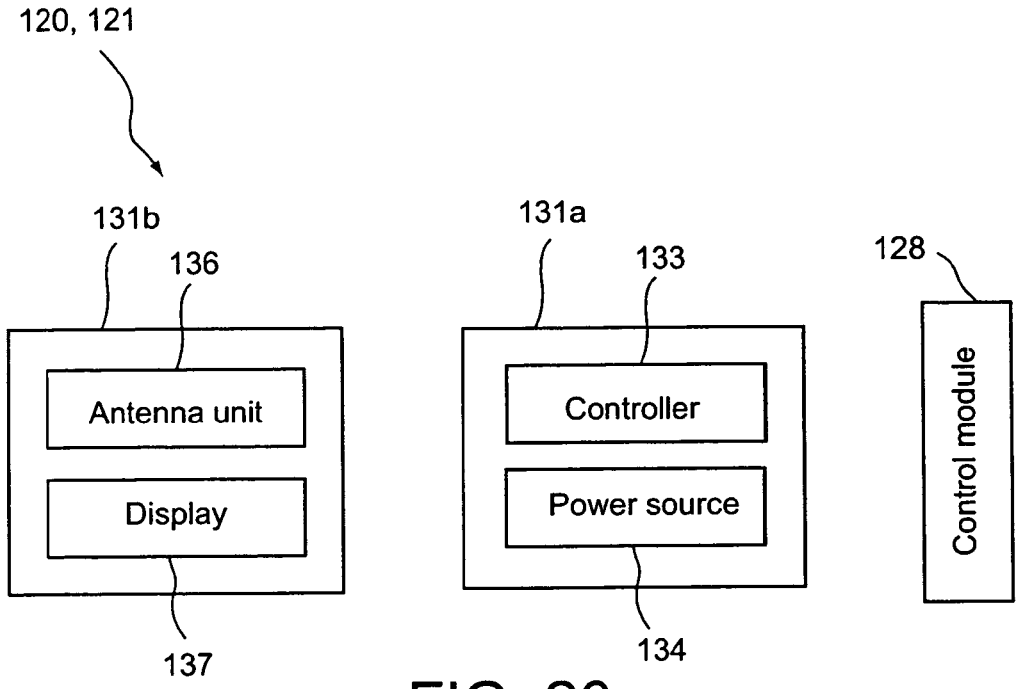
FIG. 20 is a block diagram showing the construction of an antenna unit provided at an exit.

The antenna units 120 and 121 are composed of a main body comprising main bodies 131*a* and 131*b* which are connected with a communication circuit, a controller 133, a power source 134, the antenna portion 136, the display 137. This main body is connected to (interfaced with) the traffic lane controller 129 through the controller 133 as shown in FIG. 20. The main body 131*a* houses the controller 133 and the power source 134. The main body 131*b* houses the antenna portion 136 and the display 137. The controller 133 controls the entirety of this apparatus. Further, the controller 133 is connected to the control module 128 of the traffic lane controller 129 and executes the process of an IC card that is an object of the process by communicating with the control module 128. The power source 134 supplies the power to all units.

Figure 21A:
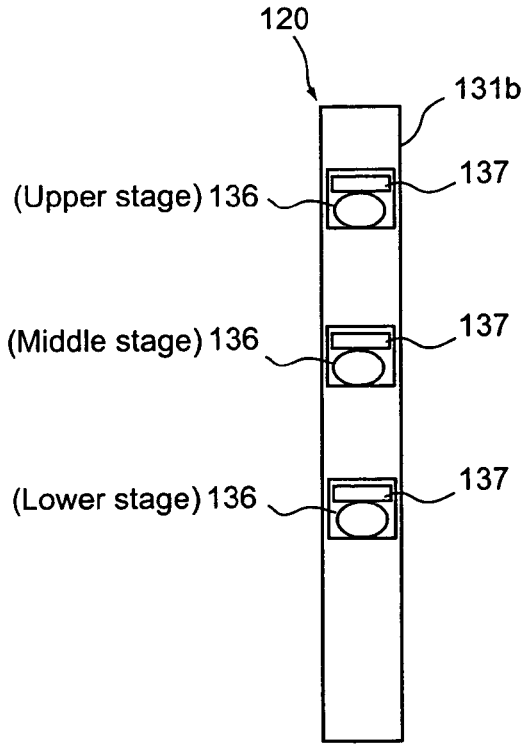
FIG. 21A is a front view showing an antenna unit arranged at the right side of a toll road.

The antenna unit 120 has a bar-shaped main body 131*b* erected at the right roadside of the traffic lane as shown in FIG. 21A. In the main body 131*b*, the antenna portion 136 and the display 137 are provided at the upper, middle and lower stages, respectively. The antenna portion 136 and the display 137 at the upper stage are for vehicles having relatively higher seats such as large type vehicle, bus, etc. The antenna portion 136 and the display 137 at the middle stage are for vehicles having a height of residential vehicle. The antenna portion 136 and the display 137 at the lower stage are for vehicles having relatively low seats such as passenger vehicle, light vehicle, bike, etc. Each of the display 137 lights, blinks or displays a message when the card processing function (the wireless communication function) of the antenna portion 136 selected by the traffic lane controller is valid. A message referred to here is such that "Please hold up your IC card over this position" or "Please wait a little until the process of the preceding vehicle is finished".

Figure 21B:
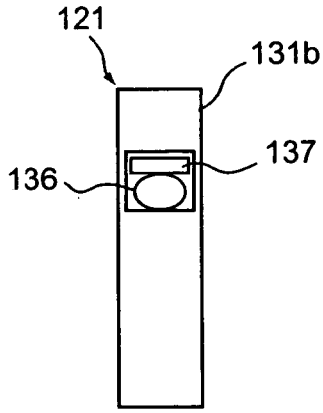
FIG. 21B is a front view showing an antenna unit arranged at the left side of a tall road.

The antenna unit 121 has a bar-shaped main body 131*b* erected at the left roadside of the traffic lane as shown in FIG. 21B. The antenna portion 136 and the display 37 are provided at the position of the same height as the lower stage of the antenna unit 120. The antenna portion 136 and the display 137 are arranged at a position to which a left handle vehicle driver is able to reach them by extending the arm through the window. The display 137 lights, blinks or displays a message when the card processing function of the antenna portion 136 is valid.

Further, to make the card processing function (the wireless communication function) of the antenna portions 136 valid or invalid, there is such a method that all antenna portions 136 are normally kept stopped and the antenna portion 136 at the position matched to the class of a vehicle only is operated when the vehicle class is discriminated by the vehicle class discriminator 122 or by operating all antenna portions 136 in advance, the antenna portions 136 other than the antenna unit at the position matched to the class of a vehicle discriminated by the vehicle class discriminator 122 may be turned off (the wireless communication function is turned off).

Further, IC cards that are used in this toll collection system, that is, wireless communication type non-contact pre-paid IC cards that can be processed by the antenna unit 130*a* of the card processor 130 and the antenna units 110 and 111 are provided with an IC chip called as a wireless tag and an antenna formed by the patterning of conductors (copper foil print wiring, etc.) on the inner substrate. Further, this embodiment is explained by taking a wireless communication type non-contact pre-paid IC card as an example, a contact type IC card equipped with metal contacts on the surface is also applicable.

Figure 22:
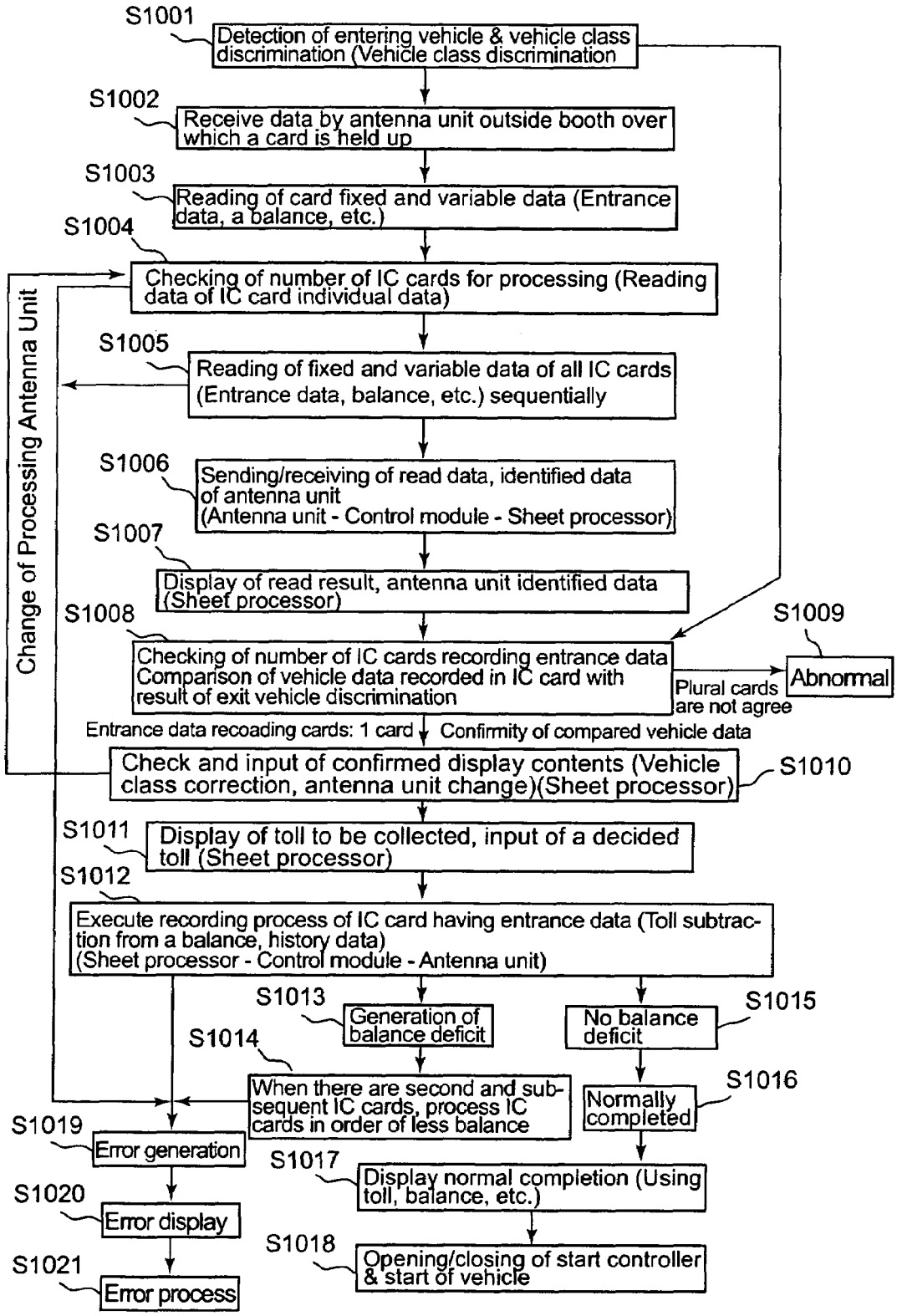
FIG. 22 is a flowchart showing the exit processing when the entrance processing is properly completed.

The operation of the toll collection process at the exit will be explained below referring to a flowchart shown in FIG. 22. FIG. 22 is the flowchart showing the exit process when the entrance process is normally completed.

At the exit lane of a toll house that is an exit of a toll road for executing the process relative to the use of a toll road by vehicles, for example, a toll collection process by reading card data including the entrance data from an IC card, the processing state of the antenna units 120 and 121 (the waiting state, card process waiting state, in-process state and process results, etc.) are constantly notified to the traffic lane controller 129 and to the sheet processor 124 from its control module 128 (S1001).

When a vehicle leaving a toll road entered into the exit lane in that state, the entry of the vehicle is detected and the vehicle class are discriminated (S1002) and the traffic lane controller 129 starts the exit process.

When the vehicle is detected by the vehicle class discriminator 122, the traffic lane controller 129 makes the card processing function valid by operating the antenna unit 120 or 121 for executing the card processing.

When a driver of the vehicle entered in the traffic line stops the vehicle at the positions of the antenna unit 120 and 121, holds up at least a sheet of IC card over the nearest antenna portion 136 by extending the arm through the window of the vehicle, that antenna portion 136 starts the wireless communication with the first IC card held up and receives card data (S1002). Then, the antenna unit 120 reads such fixed data as individual data of the IC card and variable data as the entrance data including vehicle class data, a balance of pre-paid amount, etc. (S1003), and checks the number of IC cards to be processed (S1004). That is, how many IC cards must be processed is checked. After verifying the number of IC cards to be processed, the antenna unit 120 reads fixed and variable data of all IC cards (S1005) and transmits the checked result (the read data) to the sheet processor 124 through the control module 128 of the traffic lane controller 129 (S1006). Further, when the toll collection process was already executed at another antenna unit through the process of IC card or the hand-over of a passing ticket, the system becomes the waiting state of process.

At this time, when such read data as fixed and variable data (vehicle class data, entrance data) of all IC cards are received from the antenna unit 120, the control module 128 transmits a toll computed from the read result (the read data) and a rate table set for the control module itself and data for identifying the antenna unit (the antenna unit 120 or 121) that is in process jointly to the sheet processor 124 (S1006).

When the IC card reading result (the read data) is received, the sheet processor 124 displays the read result (the read data), a toll to be collected and the antenna unit identification data on the display unit (S1007).

Further, when there were plural IC cards to be processed and as a result of reading data recorded on the IC cards sequentially, the entrance data was recorded on one sheet only of the IC card, the control module 128 computes a toll to be collected based on the entrance data recorded on that IC card.

Further, the control module 128 checks the consistency of the vehicle data recorded in the IC card with the result of the vehicle class discrimination at the exit by comparing both of them (S1008). Further, when it was found that the entrance data was recorded on plural IC cards as a result of the reading or when inconsistency was recognized as a result of the comparison of both data, the abnormal process is executed because an illegal deed such as the exchange of IC cards between different vehicles was possibly made (S1009). The abnormal process is a process to display individual data of unmatched IC cards on the display or to inform a clerk in-charge through the voice message.

When the display of the reading result and a toll to be collected on the sheet processor 124 was completed, a clerk in-charge checks the class of the vehicle in process and the display contents by the applicable antenna unit (S1010).

Then, the re-computation of a toll or the change of an antenna unit are processed in the sheet processor by inputting the change of an antenna unit for executing the correction of vehicle class and correction as necessary.

For example, when a vehicle class, etc. were corrected, the traffic lane controller 129 re-computes a toll to be collected and a new toll is displayed on the sheet processor 124. Further, when an antenna unit that executes the process was changed, the traffic lane controller 129 interrupts the process of the antenna unit 120 in process and have a selected antenna unit start the reading process.

Then, a clerk in-charge checks the display contents on the display of the sheet processor 124, decides and inputs a toll (S1011). When a toll is decided, the control module 128 directs the applicable antenna unit 120 to record the data after subtracting a toll and the history data of the toll collection process. According to this direction, the antenna unit 120 starts the process to subtract a toll from the IC card that records the entrance data. When an amount on a first IC card was still short for a toll even after the whole amount on the first IC card was subtracted, the toll subtraction process from the second and subsequent cards having a less balance is executed until the toll collection is completed.

In the toll subtraction process, required data (a balance data after subtracting a toll and the history data of the toll collection process) are recorded on the IC card that stored the card data including the entrance data (S1012). Further, while a series of toll collection processes is executed, the in-process indication is displayed on the display 137 of the antenna unit 120.

When, for example, a balance deficit is generated in the subtraction process for a first IC card (S1013) and there is a second IC card, the control module 128 directs the antenna unit 120 to execute the subtraction process in order of less balance (S1014).

Further, when there is no balance deficit (S1015) and the toll collection was normally completed (S1016), the normal completion of the toll collection, a used toll and a balance are displayed on the display 137 near the antenna portion 136 or the display for users 123 (S1017).

After the toll collection process was normally completed, the traffic lane controller 129 opens the blocking bars 127*a* and 127*b* and approves the vehicle to pass the exit. When the vehicle started and the passage of the vehicle was detected by the start detector 126, the blocking bars 127*a* and 127*b* of the start controller 127 are closed (S1018).

When any error was generated in the process in either the above steps S1004, 1005, 1012 and S1014 (S1019), the error generation is displayed on applicable display (S1020) and the error process is executed (S1021).

Further, when the entry of a succeeding vehicle is detected by the vehicle class discriminator 122, the traffic lane controller 129 starts to accept the IC card process for the succeeding vehicle.

Further, this toll collection system has a function to detect an illegal deed by exchanging IC cards in a toll road.

That is, in the entrance process of a vehicle passing through a toll road executed at the entrance and the exit processing executed at the exit, when the vehicle entering into the entrance of the toll road is specified by the vehicle class discriminator 112, the card data is read by the antenna portion 146 from an IC card held up over the antenna portion 146 that is provided at the entrance of the toll road and when the card data is normal, the vehicle data specified by the vehicle class discriminator 112 is written on the IC card.

On the other hand, when any antenna portion 136 reads the entrance data from the IC card that is held up over it or touches it at the exit, the control module 128 of the traffic lane controller 129 judges whether the same IC card was used by the same vehicle in the entrance and exit processes based on the vehicle data contained in the entrance data (Number Plate No.) and read by the antenna portion 136 and the data of the vehicle specified by the vehicle class discriminator 122. When it was judged that the IC cards used at the entrance and the exit were different, the control module 128 of the traffic lane controller 129 displays the suspicion of illegal deed and reports it to the sheet processor 124.

Thus, it becomes possible to detect an illegal deed by exchanging IC cards by vehicles and prevent such illegal deeds.

Figure 23:
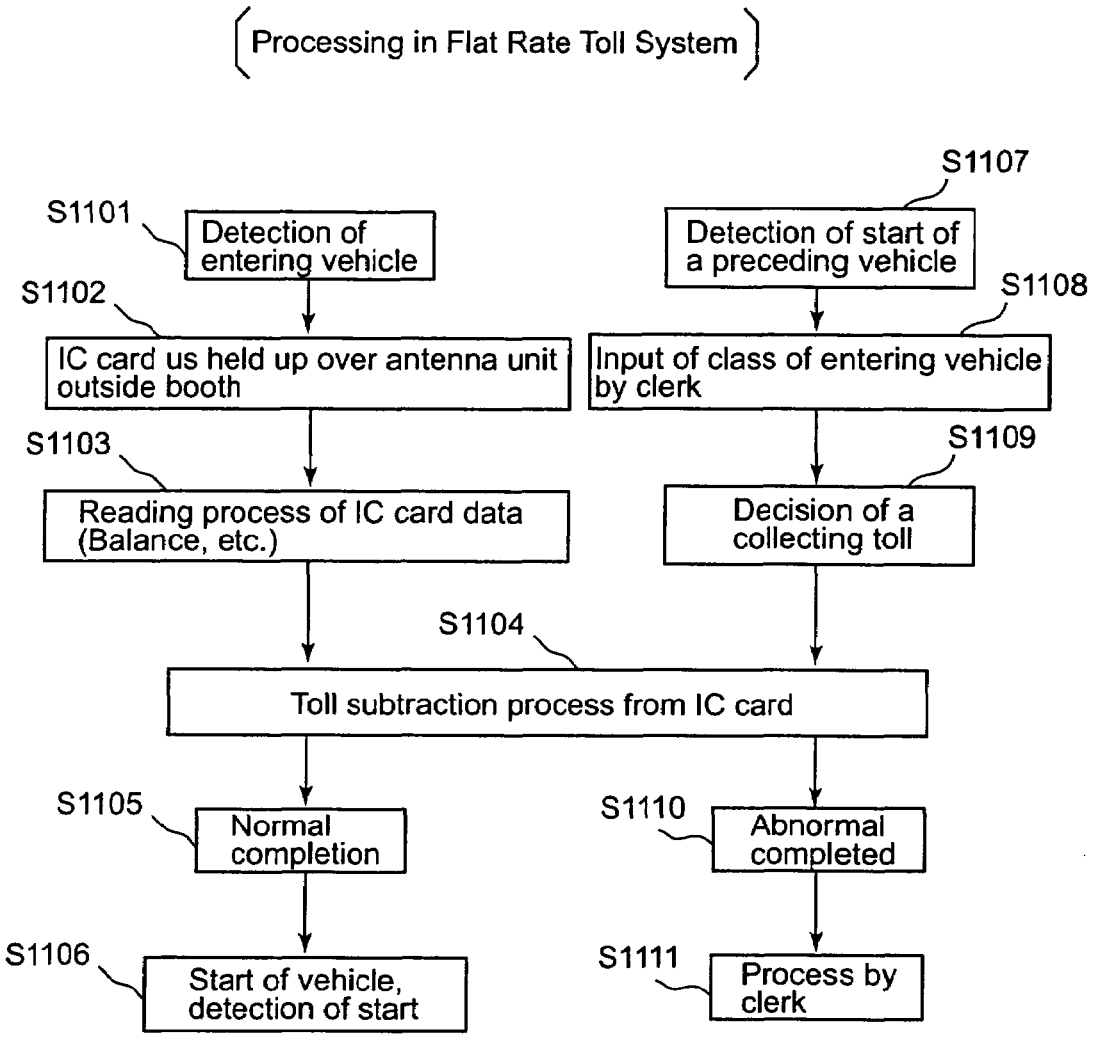
FIG. 23 is a flowchart showing the processing in a uniform toll system.

Next, the process in a flat rate toll system will be explained referring to a flowchart shown in FIG. 23. FIG. 23 is a flowchart showing the process in the flat rate toll system.

In the case of a flat rate system to collect a fixed amount of toll at the exit without a toll house provided at the entrance of a toll road, the arrangement of antenna units is the same as that of the exit system of a per distance accounting system. The antenna unit 120 is installed at the position of the booth 105 at the right side in the vehicle traveling direction of the exit lane likewise the entrance. The antenna portions 136 is provided to plural stages (for example, 3 stages of the upper, middle and lower stages or 2 stages of the upper and lower stages, the antenna unit 121 is provided at the position of the left side in the vehicle traveling direction of the exit lane opposing to the right side antenna units 120 likewise the entrance, and the antenna portion 136 is provided at one stage (the lower state position) in the vertical direction (the height direction) of the antenna unit 121. Further, a toll collection terminal is installed in the booth 105. The toll collection terminal is provided with a display for displaying processing data including card data and vehicle class data read from an IC card and such input means as a vehicle class designating button, a confirming button, a vehicle class changing button, etc.

That is, this flat rate system is provided with a display of the toll collection terminal for urging whether the vehicle data input through the vehicle class designation button (the input means) of the toll collection terminal can be determined as the data for processing and the control module 128 to make the antenna portion 136 write the card processing result using the decided processing data onto an IC card.

In the toll collection process according to the flat rate system, after a vehicle entering into the exit lane is detected by the vehicle class discriminator 122 (S1101), a user holds up an IC card over the antenna portion 136 (S1102).

Then, the antenna portion 136 executes the individual data reading process of the IC card including a balance of the account (S1103). The read result is displayed on the toll collection terminal installed in the booth 5, and when a clerk inputs a vehicle class, a collected amount, a balance, etc., the input data are confirmed and if there is no problem matter, a toll to be collected is decided and the subtraction process is executed. (S1104).

In the toll subtraction process, a balance after the subtraction of the toll, etc. is written into the IC card through the antenna portion 136. Further, when the card process was normally completed in the flat rate process, the IC card is processed by a clerk in-charge.

In the process by a clerk in-charge, when a user who is a vehicle driver hands over an IC card to a clerk in-charge, the clerk processes the card using the card processor 130 that is built in the antenna unit 130*a* installed in the booth 5.

When the card process was normally completed, the vehicle driver starts the vehicle and this start is detected by the start detector 26 (S1106).

Further, there will be no problem when a vehicle class is input for computing a toll for a vehicle to be processed before or after a user who is a driver of a vehicle entering into the exit lane holds up an IC card over any antenna portion 136.

Accordingly, when a clerk in-charge inputs a vehicle class by the vehicle class designation button of the toll collection terminal (S1108) after the toll collection process of a preceding vehicle was completed and the vehicle start was detected by the start detector 126 (S1107), the input vehicle class is regarded valid and the toll collection terminal decides a toll to be collected for the input vehicle class (S1108).

In the case when a succeeding vehicle entering into the exit lane pays a toll using an IC card under this state (S1101~S1104), if the succeeding vehicle is the same class as the preceding vehicle, when an IC card is held up over the antenna portion 136, a balance data contained in the card data read from the IC card and the vehicle class data decided in the process in S1108 are displayed on the toll collection terminal and the input of the final decision in executing the toll subtraction process is urged. So, only when a clerk in-charge pushes the decision button of the toll collection terminal, the toll collection process is executed by the toll collection terminal and the required operation at this time is simplified. In the circumstances where vehicles in the same class enter into the traffic lane successively, the process efficiency can be improved. Further, when the vehicle class displayed on the toll collection terminal differs from an actual vehicle class, the vehicle class can be changed by pushing the vehicle class changing button of the toll collection terminal by a clerk.

Here, for example, when the IC card process was not normally completed but abnormally completed (S1110), that IC card is processed by a clerk in-charge (S1111).

In the processing by a clerk, a user hands over an IC card to a clerk. The clerk executes the read/write process (R/W process) using the card processor 130 installed in the booth 105.

When the present invention is introduced into the flat rate system, as it is so devised that the next vehicle class can be input in advance after detecting the passing of a preceding vehicle, the process efficiency when the same vehicles are successively entering in the lane can be improved.

Further, in the system in the above-mentioned embodiment, a vehicle with the handle provided at the right side and traveling a road at the right side as in Japan was explained. However, when this invention is applied in U.S.A. wherein vehicles with the handle provided at the left side are adopted, for example, the vehicle class discriminator 12, the roadside display 15, the traffic lane controller 19, the passing ticket issuer 13 and the start controller 17 shown in FIG. 3 are arranged at the left side of a road, and the passing ticket issue for right handle vehicles is provided at the right side of a road.

As explained in the above, according to the present invention, an antenna unit for executing the card process through the wireless communication with IC card is arranged in the booth installed at the traffic lane for executing the process relative to the use of a toll road for vehicles traveling the toll road. Also, at least one antenna unit is arranged at the roadside of the traffic lane outside the booth. When the process relative to the use of a toll road is executed based on the card data obtained at the time of the card process by at least one of these plural antenna units, it becomes possible to introduce an IC type pre-paid card system with enhanced security while maintaining convenience of anonymous and disposable magnetic type pre-paid card as a toll collection system of a toll road with safety of vehicle traveling.

Further, according to the present invention, a class of a vehicle entering into the traffic lane of a toll road is discriminated and a passing ticker is issued from a passing ticket issuer provided at a height corresponding to the discriminated vehicle class. When the IC card process is executed by one of plural antenna units installed at positions near the passing ticket issuers, an issued ticket is stored and therefore, the issue of a passing ticket in the entrance process and the card process by the antenna unit can be executed separately.

Further, when an error is generated in the IC card process by the antenna unit, a passing ticket is issued from a passing ticket issuer installed at a position close to that antenna unit. Therefore, a user is able to get a passing ticket almost at the same position when the IC card was processed.

Furthermore, when a user holds up plural IC cards over the antenna unit, the antenna unit subtracts a toll from a balance amount data contained in the card data including the entrance data from plural IC cards. Therefore, a user is able to pay a toll from plural IC cards likewise magnetic cards.

In addition, a vehicle entered into the entrance of a toll road is specified and the entrance data containing the specified vehicle data are written into an IC card. At the exit, the antenna unit at the exit reads the entrance data from the IC card and judges whether the IC cards used at the entrance and the exit are the same IC card based on the vehicle data contained in the entrance data and the vehicle data specified at the exit. When the IC cards used at the entrance and the exit are judged to be different in the processing of the vehicle, a doubt of illegal deed is reported. Therefore, the illegal deed by exchanging IC cards of different vehicles can be detected and thus, illegal deeds can be prevented.

What is claimed is:

1. A card processing system, comprising:

a first antenna unit set in a booth provided at a road side of a traffic lane so as to process data in an IC card with respect to use of a toll road for a vehicle passing the toll road through a wireless communication with the IC card;

a second antenna unit set at the road side of the traffic lane outside the booth to process the data through a wireless communication with the IC card; and a data processor to process the data relative to use of the toll road based on the card data obtained from either one of the first and second antenna units, wherein the first and second antenna units read and process the card data containing vehicle class data from the IC card and execute the data process of the IC card, further comprising:

a controller to judge whether a vehicle currently in process is a two-wheeled vehicle or other than a two-wheeled vehicle from the vehicle class data read by either the first or second antenna unit and control acceptability of data process for the remaining antenna unit according to the result of the judgment.

2. A card processing system, comprising:

a first antenna unit set in a booth provided at a road side of a traffic lane so as to process data in an IC card with respect to use of a toll road for a vehicle passing the toll road through a wireless communication with the IC card;

a second antenna unit set at the road side of the traffic lane outside the booth to process the data through a wireless communication with the IC card; and a data processor to process the data relative to use of the toll road based on the card data obtained from either one of the first and second antenna units, wherein the first antenna unit reads and processes the card data containing vehicle class data from the IC card, further comprising:

a passing ticket processor set in the booth to process a passing ticket by operation of a toll clerk;

a judging unit to judge whether a succeeding vehicle entering into the traffic lane during the passing ticket processing by the passing ticket processor or during the card data processing by the first antenna unit is a two wheeled vehicle or other class vehicle; and a controller to allow the second antenna unit to process the IC card data through the wireless communication with the IC card when the succeeding vehicle is a two wheeled vehicle as a result of the judgment by the judging unit.

* * * * *